US008740352B2

(12) United States Patent
Kobayashi et al.

(10) Patent No.: US 8,740,352 B2
(45) Date of Patent: Jun. 3, 2014

(54) INKJET PRINTING APPARATUS

(75) Inventors: Masahiro Kobayashi, Hachioji (JP); Yaado Sakata, Tokyo (JP); Ryoichi Katano, Kawasaki (JP); Hiroyuki Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 297 days.

(21) Appl. No.: 13/096,134

(22) Filed: Apr. 28, 2011

(65) Prior Publication Data

US 2011/0285770 A1 Nov. 24, 2011

(30) Foreign Application Priority Data

May 18, 2010 (JP) ..... 2010-114458

(51) Int. Cl.
*B41J 2/14* (2006.01)

(52) U.S. Cl.
USPC ..... 347/47; 347/49; 347/12

(58) Field of Classification Search
USPC ..... 347/5, 9, 21, 37, 45, 47, 12, 49
See application file for complete search history.

(56) References Cited

U.S. PATENT DOCUMENTS

| | | | | |
|---|---|---|---|---|
| 6,997,538 | B1 * | 2/2006 | Kawamura et al. | 347/21 |
| 7,410,241 | B2 * | 8/2008 | Yabe | 347/47 |
| 7,726,775 | B2 | 6/2010 | Maeda | |
| 8,356,881 | B2 | 1/2013 | Ohnishi | |

FOREIGN PATENT DOCUMENTS

| | | |
|---|---|---|
| JP | 2006-315226 A | 11/2006 |
| JP | 2010-137483 A | 6/2010 |

OTHER PUBLICATIONS

Office Action dated Dec. 24, 2013, in Japanese Application No. 2010-114458.

* cited by examiner

*Primary Examiner* — Lam S Nguyen
(74) *Attorney, Agent, or Firm* — Fitzpatrick, Cella, Harper & Scinto

(57) ABSTRACT

An inkjet printing apparatus suppresses air currents heading toward print head faces, and reduces the adherence of ink mist onto the print heads. The apparatus includes a carriage upon which is mounted one or more print heads with ink ejection ports formed thereon, a printing unit that prints an image onto a printing medium by causing ink droplets to be ejected toward the printing medium from the ink ejection ports while also causing the carriage to move with respect to the printing medium, and an airflow control mechanism formed on the surface of the one or more print heads or the carriage that faces the printing medium, the airflow control mechanism controlling air currents flowing into a lateral region extending along the carriage moving direction on either side of the region where the ink ejection ports are formed, and causing the air pressure to rise in the lateral region.

8 Claims, 37 Drawing Sheets

INKJET PRINTING APPARATUS

BACKGROUND OF THE INVENTION

1. Field of the Invention

The present invention relates to an inkjet printing apparatus.

2. Description of the Related Art

In an inkjet printing apparatus, since an image is formed by ejecting liquid ink, a fine ink mist is sometimes produced together with ink droplets when ejecting ink from an ejection port. In particular, countermeasures become important when printing from many ejection ports at a high driving frequency, since the amount of ink mist produced increases. In some cases, some of the produced ink mist is swept up by rising air currents heading toward the print head faces which are produced between print heads and printing medium, and adhere to the print head faces. When ejecting ink from many ejection ports at a high driving frequency, such rising air currents heading toward the print head faces are produced between print heads and printing medium by the flight of the ejected ink droplets themselves. There has been a problem in that large amounts of ink mist adhering or accumulating near the ejection ports in this way leads to ejection malfunctions, and lowers the reliability of the print heads.

Japanese Patent Laid-Open No. 2006-315226 discloses a configuration that provides a projection projecting toward the printing medium at the rear end of the print head faces in the carriage moving direction and modifies the trajectory of ink mist in order to suppress the adherence of ink mist onto the faces of print heads.

However, since the configuration disclosed in Japanese Patent Laid-Open No. 2006-315226 does not suppress the production of rising air currents heading toward the faces of the print heads, the adherence of ink mist onto the print head faces cannot be sufficiently reduced.

SUMMARY OF THE INVENTION

It is an object of the present invention to provide an inkjet printing apparatus able to suppress air currents heading toward print head faces and reduce the adherence of ink mist onto the print heads.

An inkjet printing apparatus in accordance with an embodiment of the present invention includes:

a carriage upon which is mounted one or more print heads with ink ejection ports formed thereon;

a printing unit that prints an image onto a printing medium by causing ink droplets to be ejected toward the printing medium from the ink ejection ports while also causing the carriage to move with respect to the printing medium; and an airflow control mechanism formed on the surface of the one or more print heads or the carriage that faces the printing medium, the airflow control mechanism controlling air currents flowing into a lateral region extending along the carriage moving direction on either side of the region where the ink ejection ports are formed, and causing the air pressure to rise in the lateral region.

According to an embodiment of the present invention, it becomes possible to suppress air currents heading toward print head faces and reduce the adherence of ink mist onto the print heads.

Further features of the present invention will become apparent from the following description of exemplary embodiments (with reference to the attached drawings).

DESCRIPTION OF THE EMBODIMENTS

Hereinafter, suitable embodiments of the present invention will be described. Being suitable specific examples of the present invention, the embodiment discussed hereinafter have various technically preferable limitations imposed thereon. However, it should be appreciated that an embodiment is not limited to an embodiment of the present specification if such an embodiment is in accord with the ideas of the present invention.

First, the phenomenon of ink mist adhering to the faces of print heads will be described with reference to FIGS. 27A to 30. Hereinafter, unless specifically noted, the speed of air currents will be discussed as the speed from the perspective of a moving coordinate system based on a carriage. In addition, the main scan direction of the carriage is taken to be the +x direction, the direction heading toward a printing medium from a print head face is taken to be the +z direction, and the direction in which ink ejection ports (hereinafter referred to as ejection ports) are arranged and which complies with a right-handed coordinate system is taken to be the +y direction. Also, in the case where a plurality of print heads are mounted on the carriage, the print heads shall be referred to as the first print head, the second print head, and so on in order from the front side of the carriage moving direction.

Figure 27A:
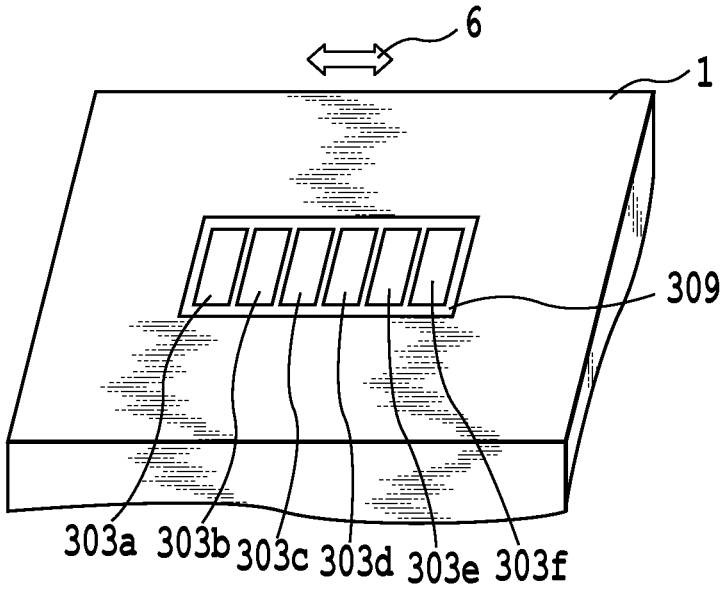
FIGS. 27A and 27B are diagrams for explaining an exemplary carriage in a first exemplary configuration of the related art, and the shape and air flow of a facing surface of the print heads that faces a printing medium.
Figure 27B:
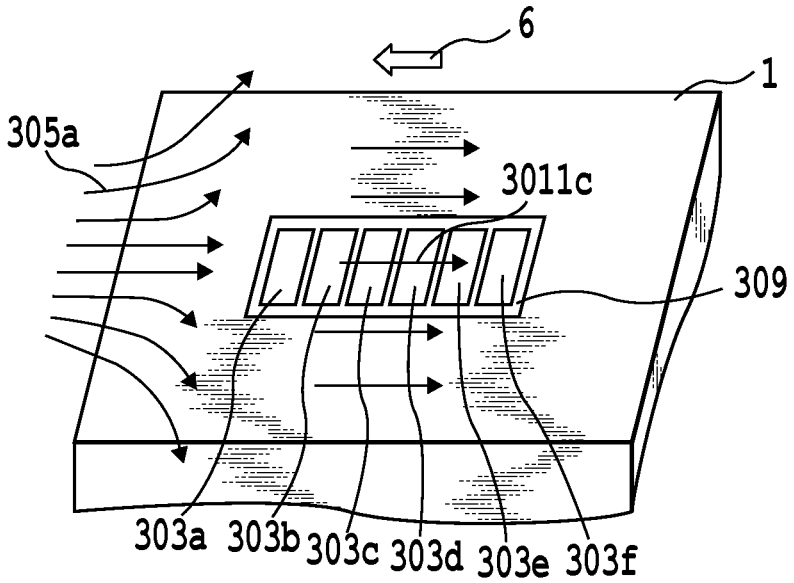
Figure 28:
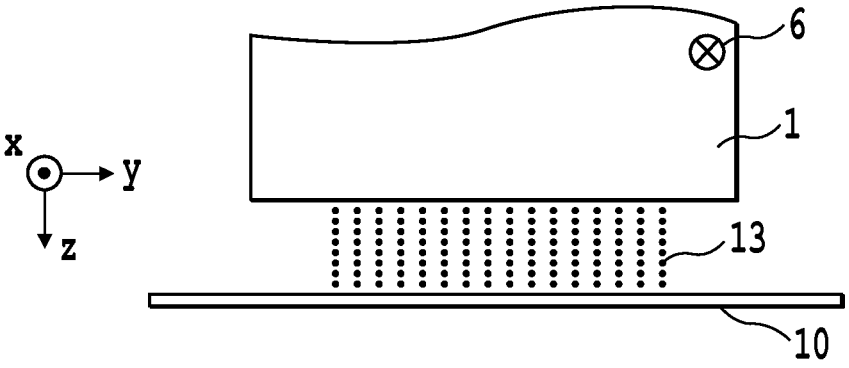
FIG. 28 schematically illustrates how ink is ejected in the first exemplary configuration of the related art.
Figure 29:
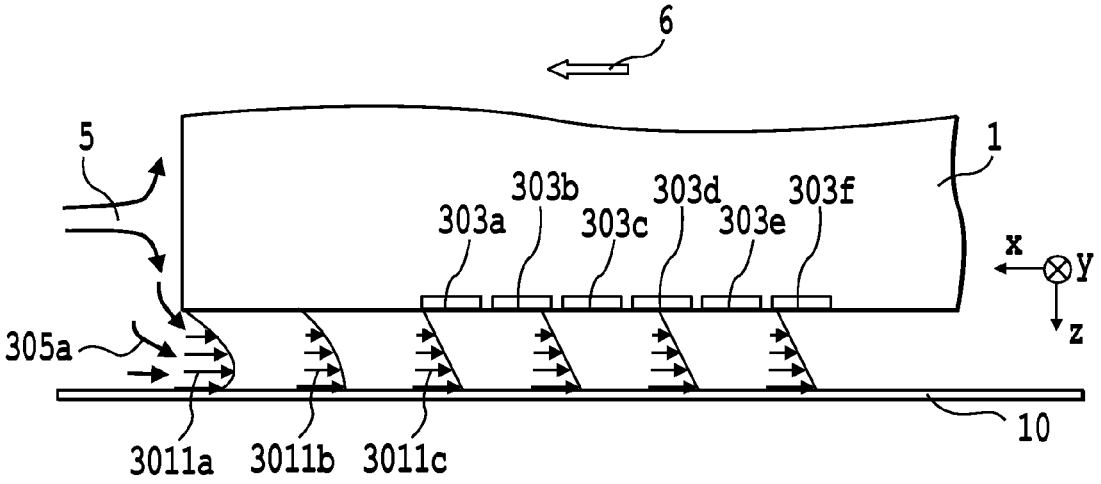
FIG. 29 is a diagram for explaining exemplary air flow in a space enclosed between a carriage and a printing medium.
Figure 30:
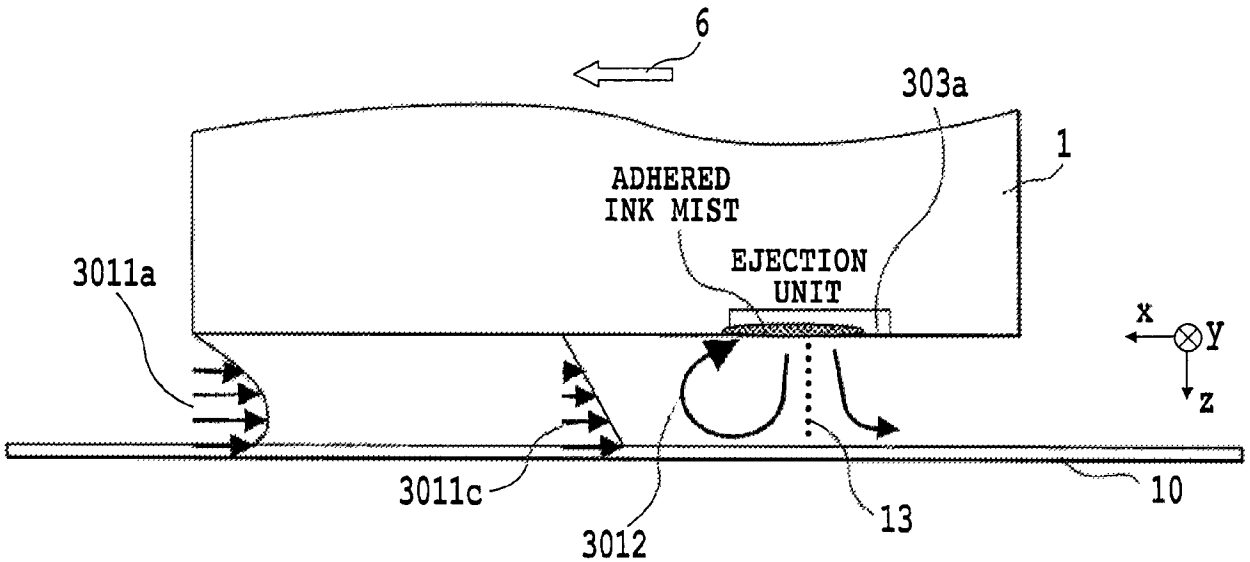
FIG. 30 is a diagram for explaining the cause of rising air currents heading toward the print head faces in the first exemplary configuration of the related art.

FIGS. 27A and 27B illustrate the state of a carriage and print heads in a first exemplary configuration of the related art as viewed from a printing medium. As illustrated in FIG. 29, in this case, air 5 collides with the side of a carriage 1 that faces the carriage moving direction 6, is contracted, and flows in between carriage and printing medium (see FIG. 29, 305*a*). At this point, the air pressure rises at the entrance between carriage and printing medium where contracted air 305*a* has flowed in, and air escapes to the surrounding regions of lower pressure (see FIG. 27B). In other words, as illustrated in FIG. 27B, in the first exemplary configuration of the related art, the majority of air 3011*a* flowing in between carriage and printing medium escapes to lower-pressure space by being released in the sheet feed and discharge directions. As a result, as illustrated in FIG. 29, the large amount of air 3011*a* flowing in escapes in the sheet feed and discharge directions a slight distance away from the entrance between carriage and printing medium. Meanwhile, at the ejection units, the air flow decays to approximately shear flow between walls, as illustrated by 3011*c*. FIG. 30 schematically illustrates air currents between carriage and printing medium when ink is ejected as illustrated in FIG. 28 in the first exemplary configuration of the related art. As illustrated in FIG. 30, a strong rising air current 3012 heading toward the print head faces 303*a* to 303*f* is produced at the ejection units, and ink mist adheres to the print head faces 303*a* to 303*f*.

In addition to the rising air currents heading toward the print head faces that are produced because of the flight of ink droplets, the Inventors have also focused on the existence of air currents that influence ink mist behavior. These are air currents that relatively flow into the region between carriage and printing medium and the region between print heads and printing medium due to the movement of the carriage (hereinafter referred to as influx air currents).

Thus far, the Inventors have confirmed by investigation that rising air currents heading toward the print head faces are suppressed if influx air currents are increased. The Inventors have also determined that if the rising air currents heading toward the print head faces are weakened in this way, the number of ink mists swept up with these rising air currents is also decreased, and the adherence of ink mist onto the print head faces is reduced. Consequently, in order to reduce the adherence of ink mist onto print head faces, it is important to control the balance of rising air currents heading toward the print head faces and influx air currents, and increase influx air currents at the ejection units.

Figure 31:
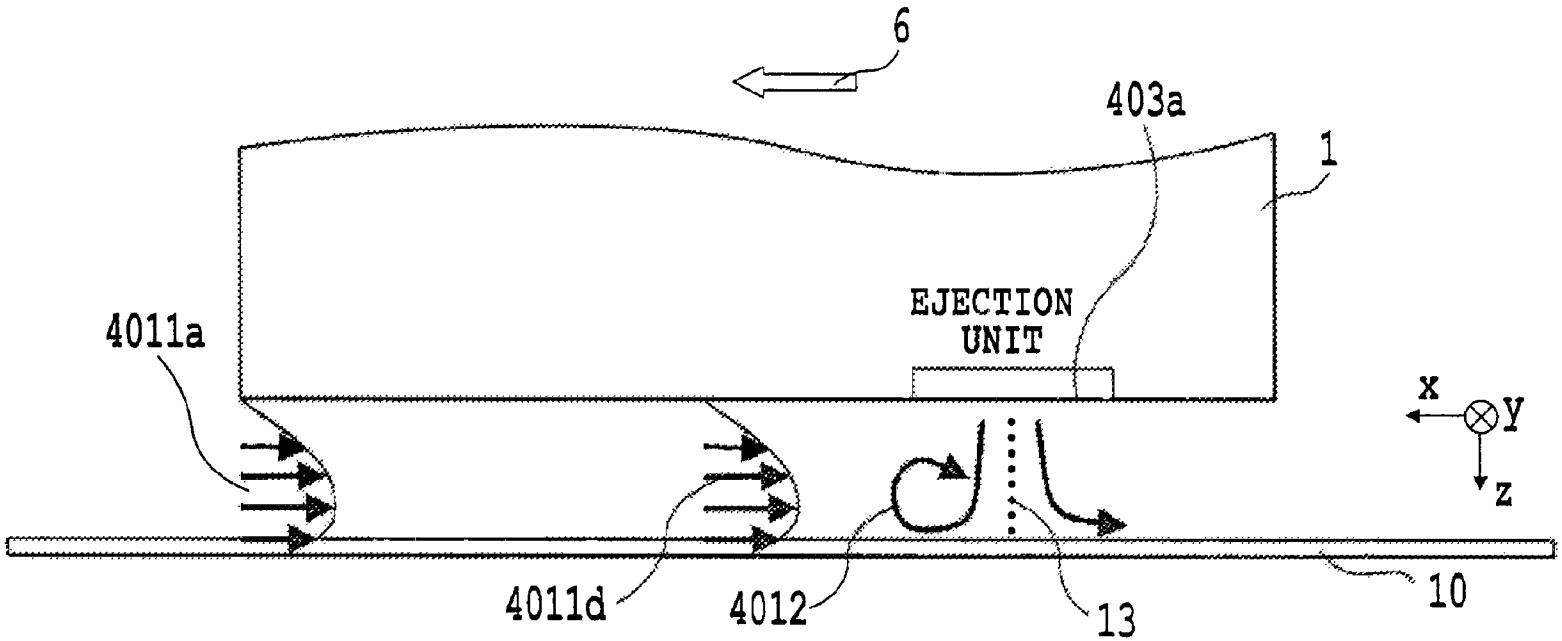
FIG. 31 is a diagram for explaining a principle of the present invention.

This state will be described using FIG. 31. If it were possible to suppress the phenomenon of air 4011*a* that has flowed in between carriage and printing medium escaping in the sheet feed and discharge directions, then as illustrated in FIG. 31, a large amount of influx air currents 4011*d* could be brought to the ejection units, and rising air currents 4012 heading toward the print head faces 403*a* to 403*f* could be effectively suppressed. As a result, it would be possible to reduce the amount of ink mist adhering to the print head faces due to rising air currents heading toward the print head faces 403*a* to 403*f*.

Hereinafter, various embodiments will be given as examples to describe configurations of an air flow control mechanism given as the key part of the present invention which is provided in order to reduce the phenomenon of air that has flowed in between carriage and printing medium or between print heads and printing medium escaping in the sheet feed and discharge directions. The air flow control mechanism herein suppresses the escape in the sheet feed and discharge directions of contracted air that has flowed in between carriage and printing medium at the front of the print heads in the carriage moving direction by increasing the air pressure of lateral regions extending along the moving direction of the carriage on either side of an ejection port formation region.

In the embodiments described hereinafter, an example of six print heads mounted onto a carriage is given, but it should be appreciated that the number of print heads mounted on a carriage may be an arbitrary number.

First Embodiment

Figure 1A:
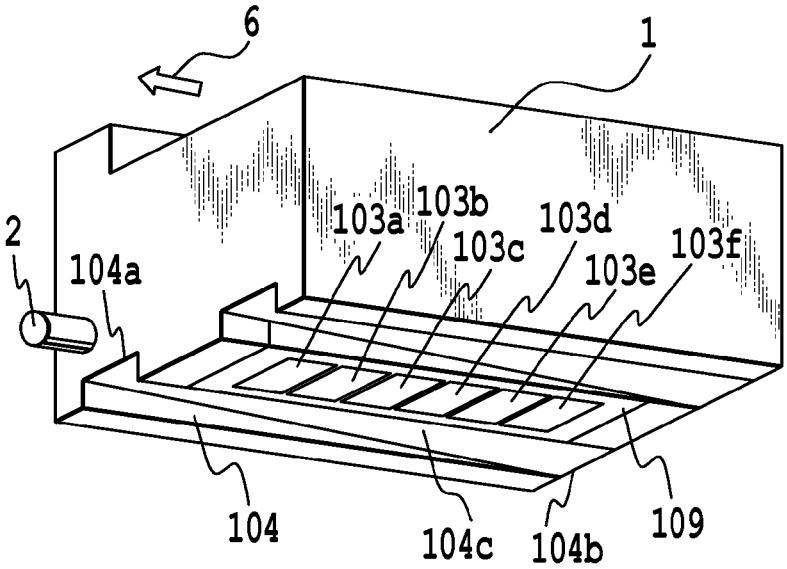
FIGS. 1A and 1B are diagrams for explaining a configuration in accordance with a first embodiment of the present invention and the flow of air currents inside a recess thereof.
Figure 1B:
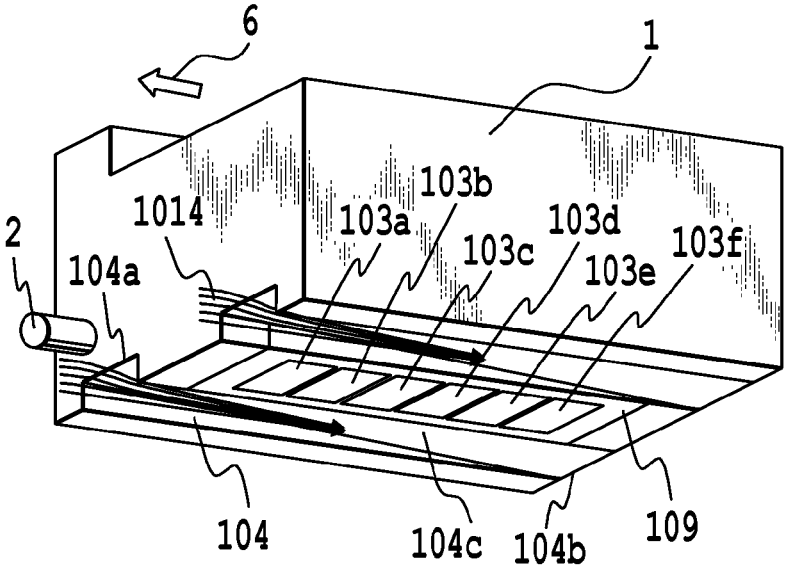

FIG. 1A illustrates a perspective view of a carriage and print heads in accordance with a first embodiment of an inkjet printing apparatus to which the present invention may be applied. FIG. 1B is a diagram for explaining the state of air currents. On either side in the carriage moving direction 6 of the print heads, a recess 104 is formed parallel to the carriage moving direction 6 on a facing surface that faces a printing medium of the carriage 1. The recess 104 communicates with the space in the forward and rear moving directions of the carriage 1 via an aperture 104*a* positioned at the tip. Meanwhile, a plurality of ejection ports not illustrated are respectively formed on each print head, similarly to FIG. 28.

The bottom surface 104*c* of the recess slopes along the carriage moving direction 6, with the depth of the recess 104 being deep at the forward edge and gradually becoming shallower near the rear edge. In so doing, the cross-sectional area in the direction orthogonal to the moving direction of the carriage 1 in the interior of the recess 104 is configured to have a small cross-section 104*b* that is smaller than the aperture 104*a*.

Figure 2A:
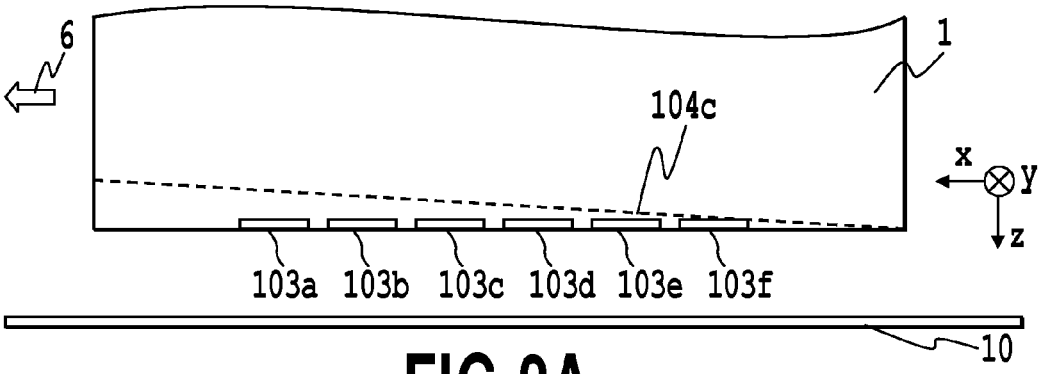
FIGS. 2A to 2C illustrate a configuration of the first embodiment of the present invention.
Figure 2B:
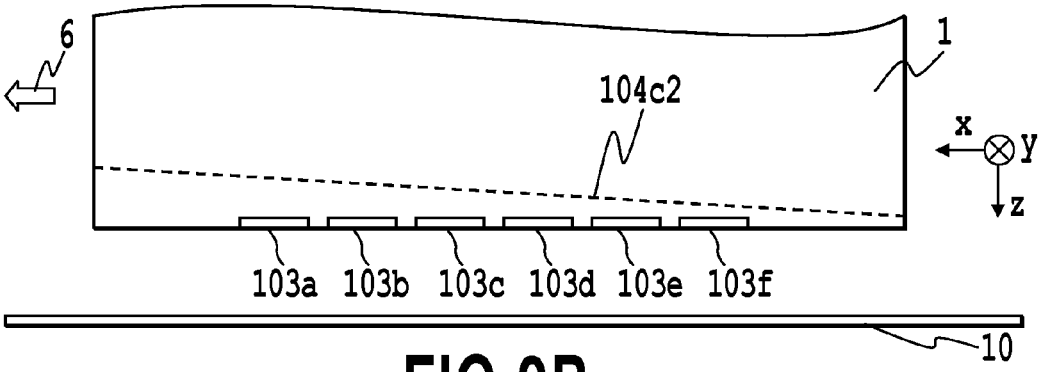
Figure 2C:
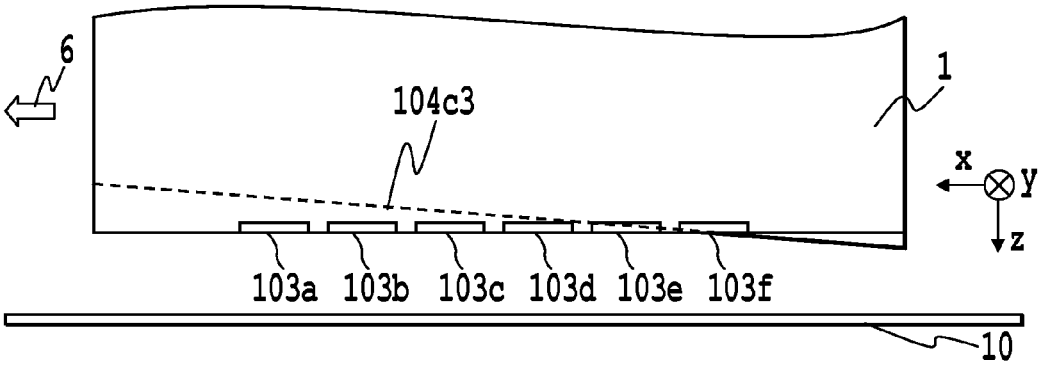

In FIGS. 1A and 1B, the height inside the recess at the small cross-section 104*b* is made to be the same height as the print head faces, as in FIG. 2A, but the height may also differ from the print head faces, as in FIGS. 2B and 2C. However, in order to prevent interference with a printing medium, a configuration is preferably such that the height inside the recess at the small cross-section 104*b* is the same height as the print head faces as in FIGS. 2A and 2B, or farther away from a printing medium than the print head faces. In other words, the recess 104 preferably does not have a portion that projects toward a printing medium farther than the print head faces upon which ink ejection ports are formed.

Figure 3A:
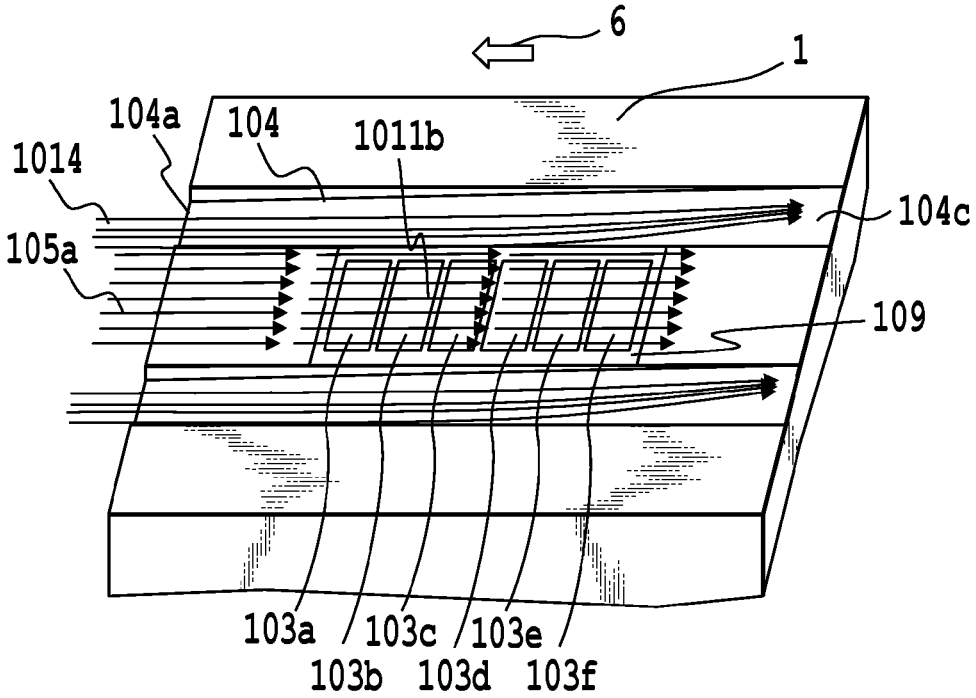
FIGS. 3A and 3B schematically illustrate functions and advantages of the configuration illustrated in FIGS. 1A and 1B.
Figure 3B:
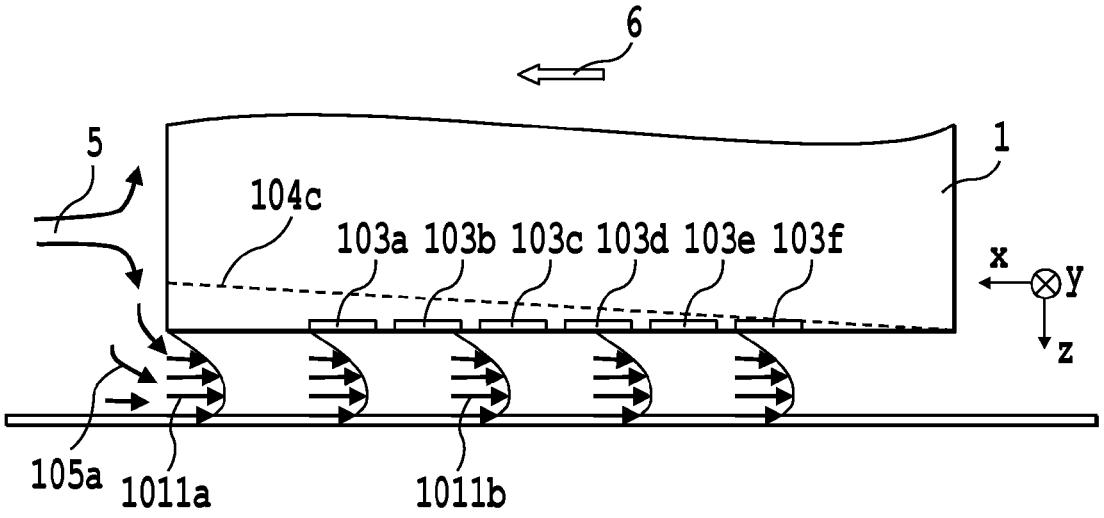

Air flow passage of the recess 104 provided with these slopes becomes narrower toward the small cross-section 104*b* so that air 1014 flowing into the recess 104 via the aperture 104*a* is harder to flow through the recess than in the case without the slopes, thereby the air pressure rising in the region between the recess and a printing medium (see FIG. 1B). In FIGS. 1A and 1B, the air pressure rises on either side of first through sixth print heads in the carriage moving direction 6. Thus, as illustrated in FIGS. 3A and 3B, air 105*a* flowing in between carriage and printing medium at the front of the print heads in the carriage moving direction 6 reaches all the way to the sixth print head, while the escape of air in the sheet feed and discharge directions is suppressed. In other words, the amount of influx air currents (1011*a* to 1011*b*) can be maintained all the way to the sixth print head (see FIG. 3B).

In this way, by increasing influx air currents at the ejection units of each print head compared to the related art, it becomes possible to effectively suppress rising air currents heading toward the print head faces (103*a* to 103*f*) which cause ink mist to adhere to the print head faces.

Figure 4A:
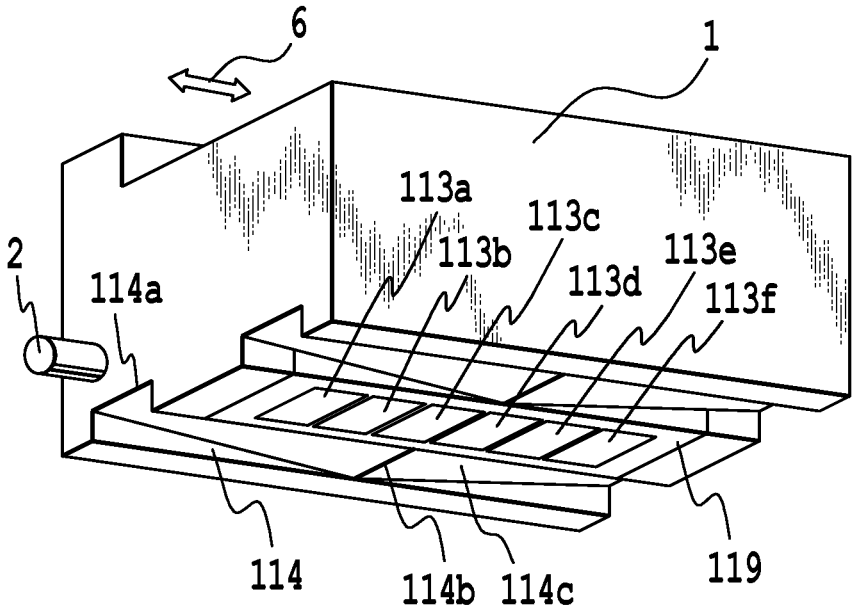
FIGS. 4A and 4B illustrate a modification of the first embodiment of the present invention.

In addition, although the carriage 1 moves backwards and forwards in the main scan direction, in the case where an image is printed in both the forward direction and the backward direction, a configuration is preferably such that the shape inside the recess is symmetrical with respect to the carriage moving direction 6 as illustrated in FIG. 4A. In the configuration in FIG. 4A, the depth of a recess 114 becomes shallower toward the interior of the carriage 1 along the carriage moving direction 6. However, the small cross-section 114*b* is not required to be positioned at the center position of the carriage 1. For example, consider the case of an ejection port array that ejects ink of a color mounted onto just a single print head during both forward moving and backward moving, and furthermore wherein the ejection port array is positioned at the approximate center of the carriage. In this case, the small cross-section 114*b* may be positioned near the ejection port array.

Figure 4B:
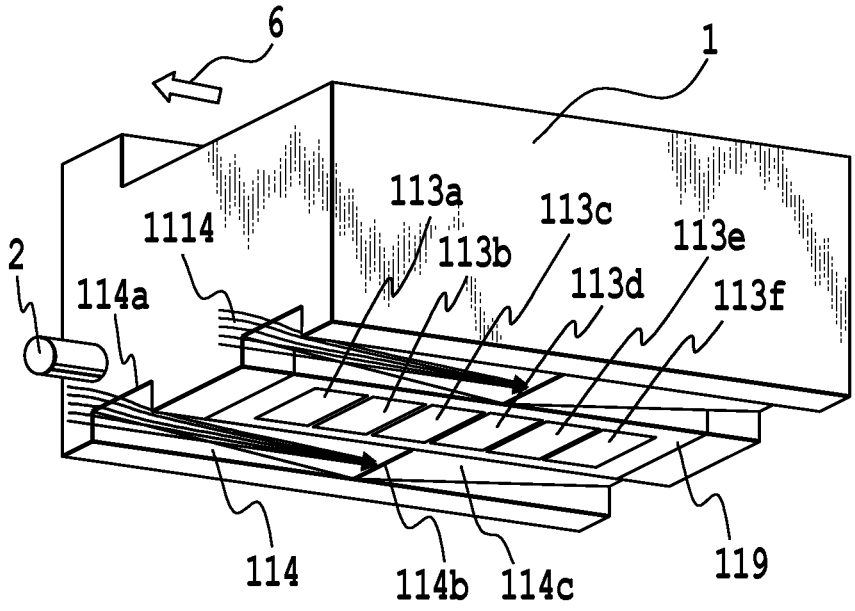
Figure 5A:
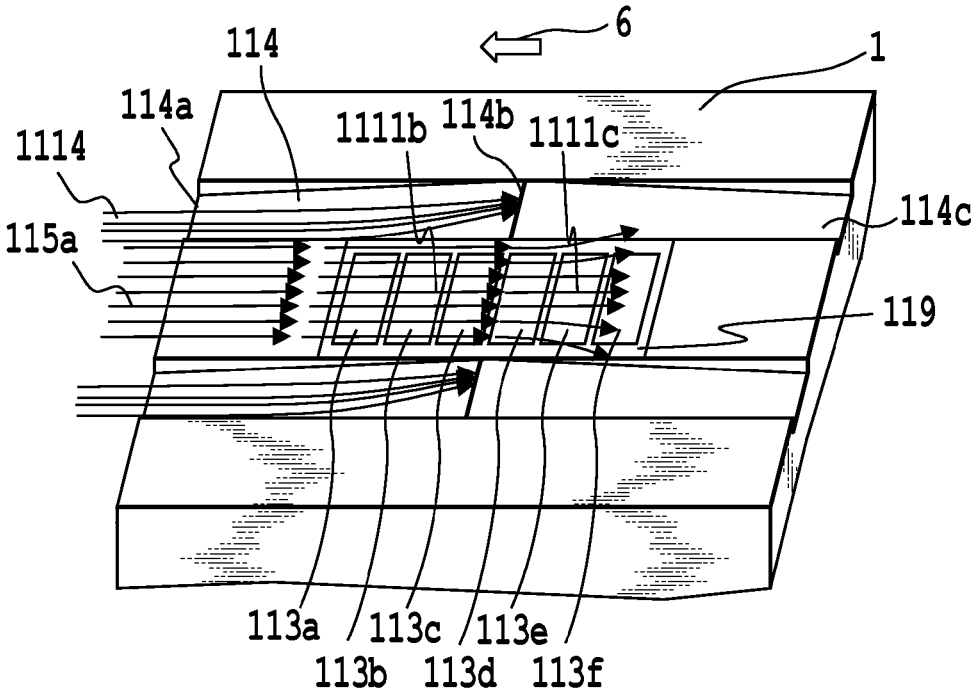
FIGS. 5A and 5B schematically illustrate functions and advantages of the configuration illustrated in FIGS. 4A and 4B.
Figure 5B:
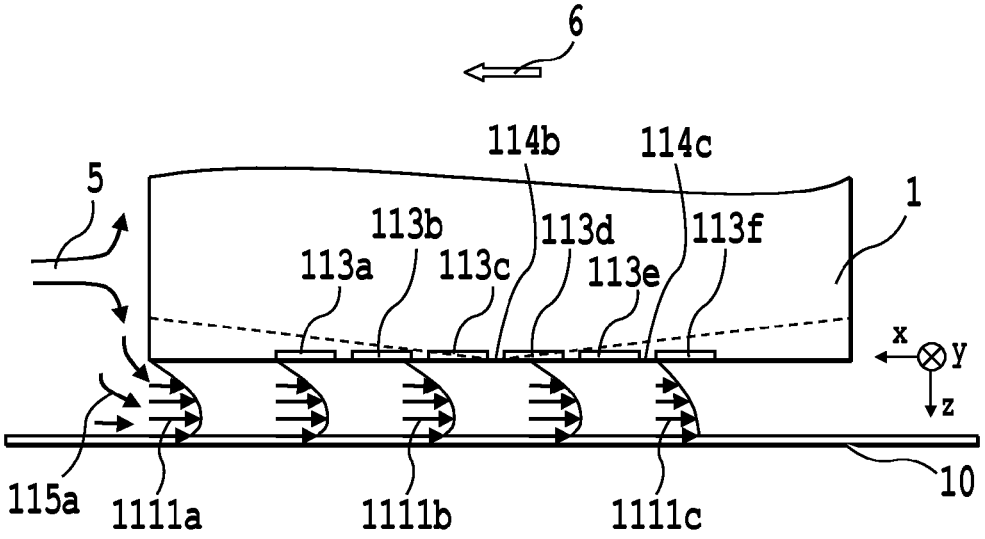

This configuration makes air flow passage narrower toward the small cross-section 114*b* so that air 1114 flowing into the recess 114 via the aperture 114*a* is harder to flow through the recess than in the case without the slopes, thereby the air pressure rising in the region between the recess and a printing medium (see FIG. 4B). In so doing, the air pressures rises on either side in the carriage moving direction 6 of the first print head through the third print head in FIG. 4A. Thus, as illustrated in FIG. 5A, air 115*a* flowing in between carriage and printing medium at the front of the print heads in the carriage moving direction 6 reaches all the way to the third print head, while the escape of air in the sheet feed and discharge directions is suppressed. In other words, the amount of influx air currents can be maintained all the way to the third print head (see FIG. 5B).

Since the above mechanism does not work on either side in the carriage moving direction 6 of the fourth through sixth print heads positioned behind the shallow position 114*b* of the recess 114 in the carriage moving direction 6, the phenomenon of influx air currents escaping in the sheet feed and discharge directions does occur (see FIG. 5A). However, compared to the related art, by moving the position where influx air currents start to escape in the sheet feed and discharge directions to a position behind the third print head in the carriage moving direction 6, there is an advantage of increased influx air currents over the related art, even for the fourth print head and subsequent heads (see FIG. 5B).

In this way, by increasing influx air currents at the ejection units of each print head compared to the related art, it becomes possible to effectively suppress rising air currents heading toward the print head faces (113*a* to 113*f*) which cause ink mist to adhere to the print head faces. In FIGS. 1A and 1B or FIGS. 4A and 4B herein, the inner walls of the recess are taken to be planar in shape, but it should be appreciated that the inner walls may also have a curved shape.

Second Embodiment

Figure 6A:
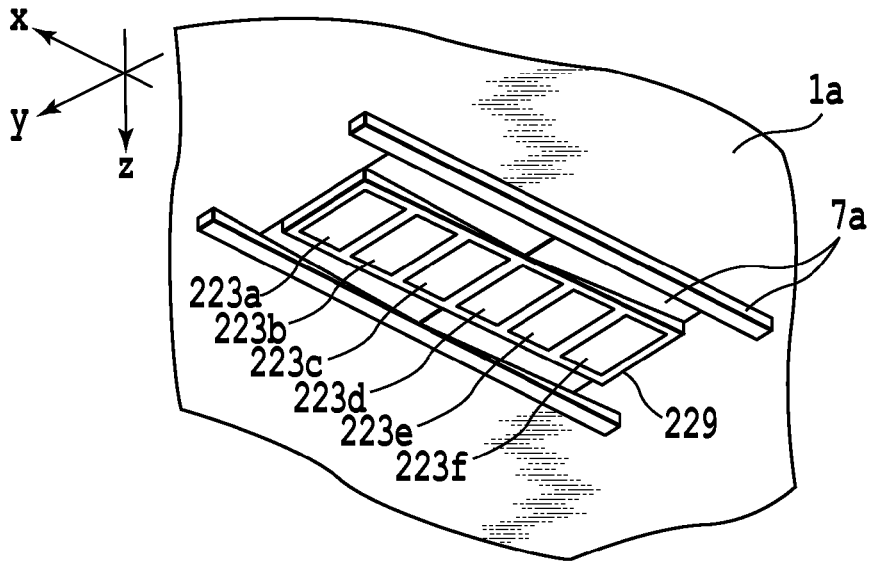
FIGS. 6A and 6B illustrate a second embodiment of the present invention.
Figure 6B:
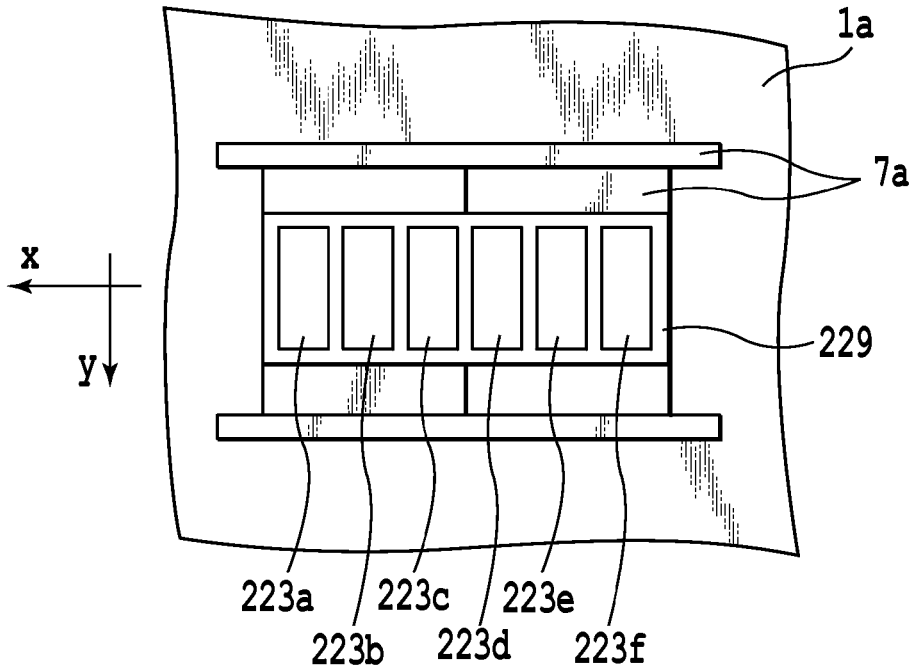
Figure 7:
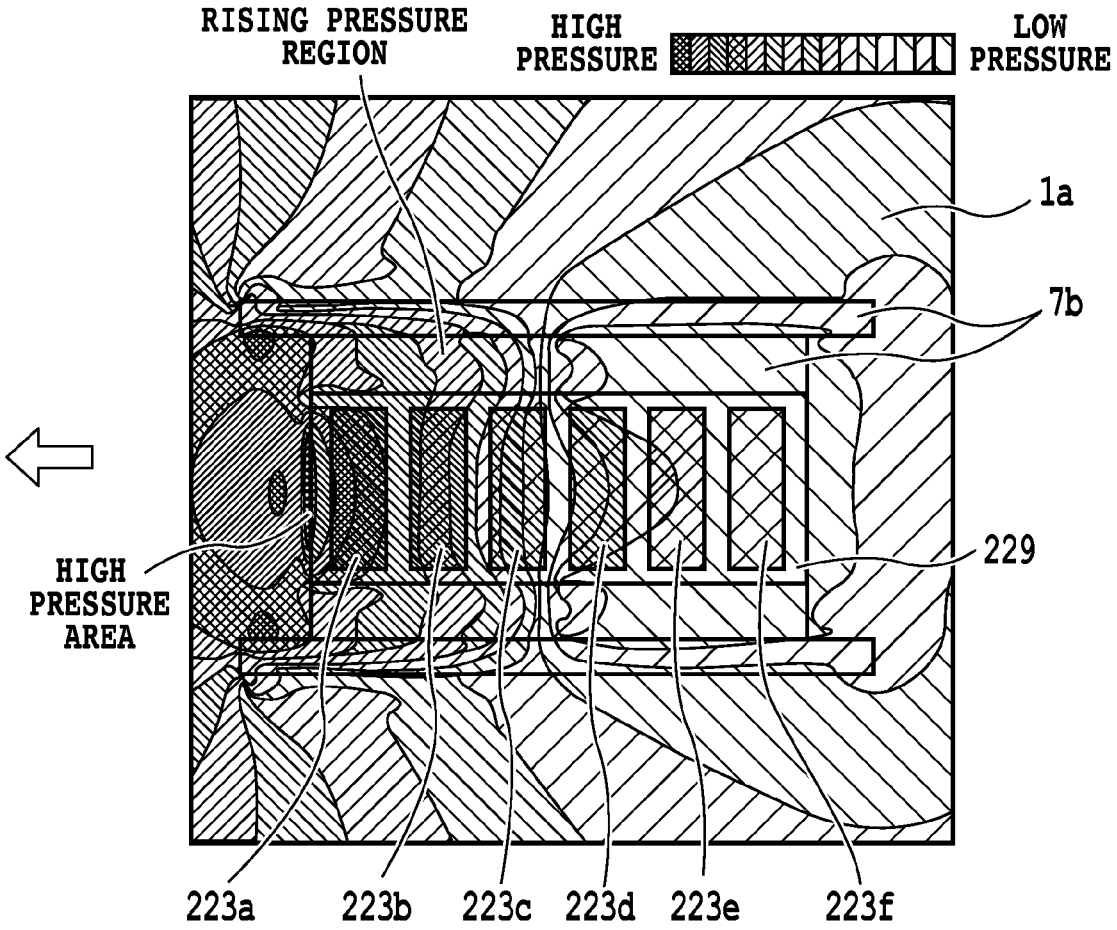
FIG. 7 illustrates an exemplary wall surface pressure distribution near first through sixth print heads in the second embodiment.
Figure 8A:
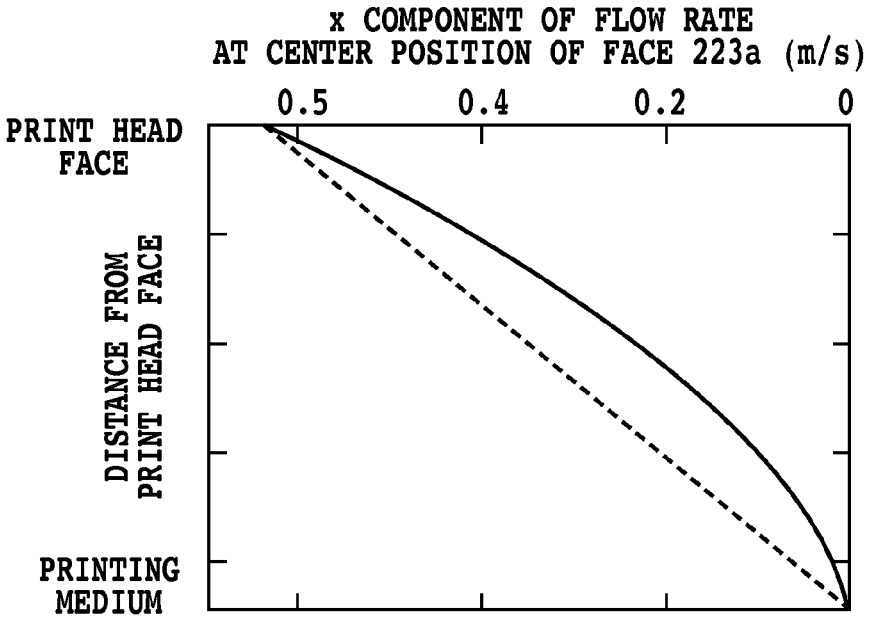
FIGS. 8A to 8F illustrate exemplary height distributions for the x component of the flow rate in a fixed coordinate system at the center positions of the respective faces of the first through sixth print heads in the second embodiment.
Figure 8B:
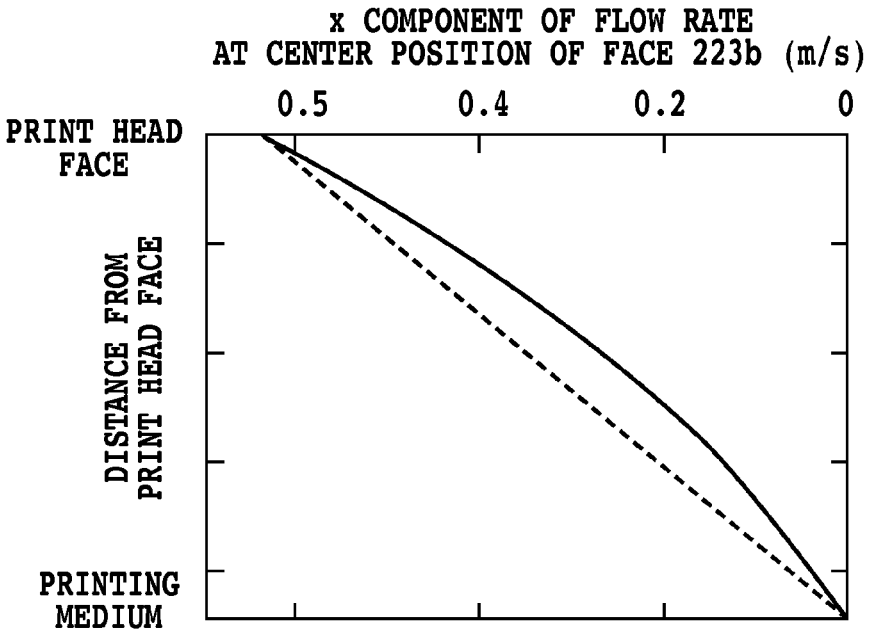
Figure 8C:
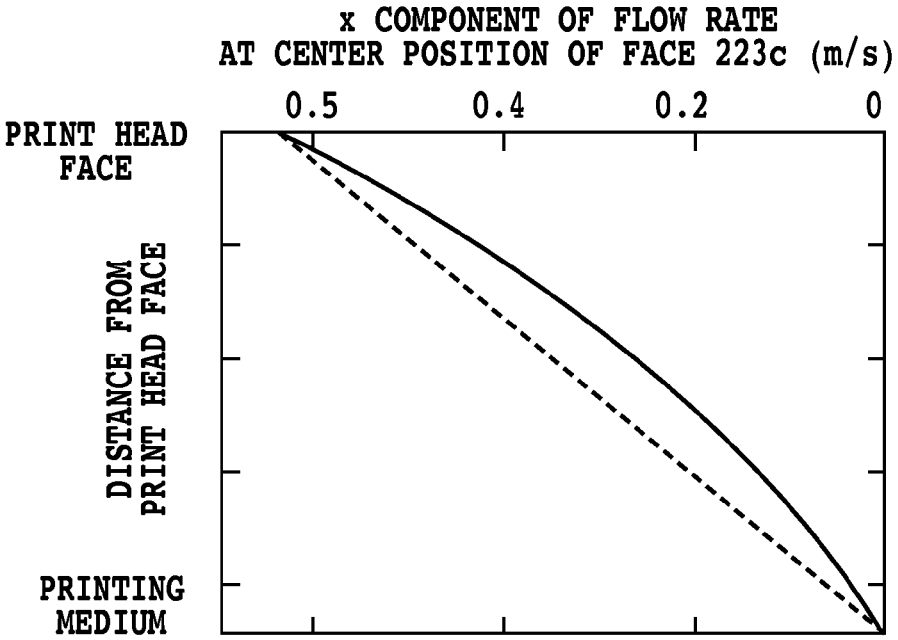
Figure 8D:
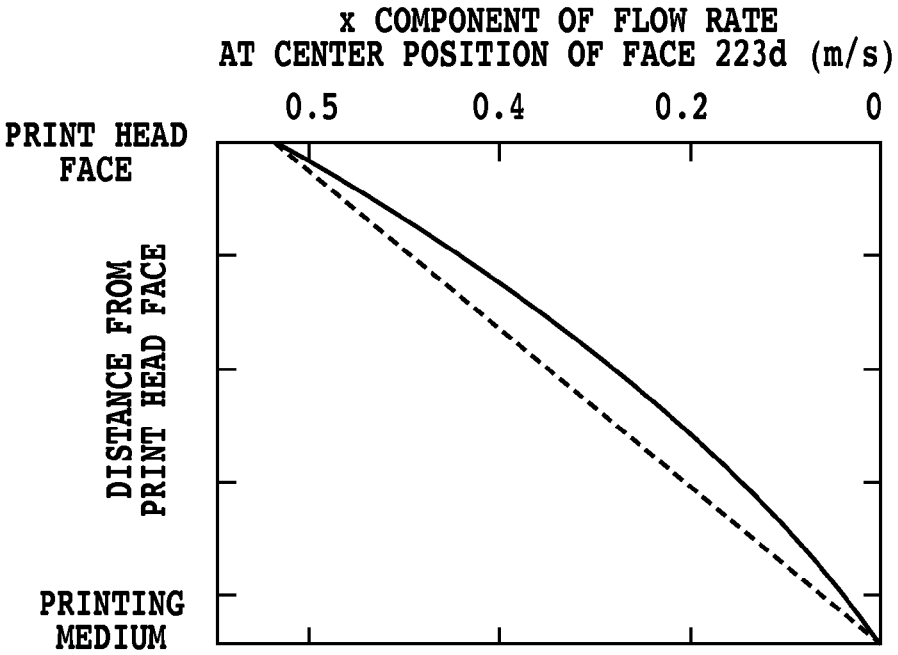
Figure 8E:
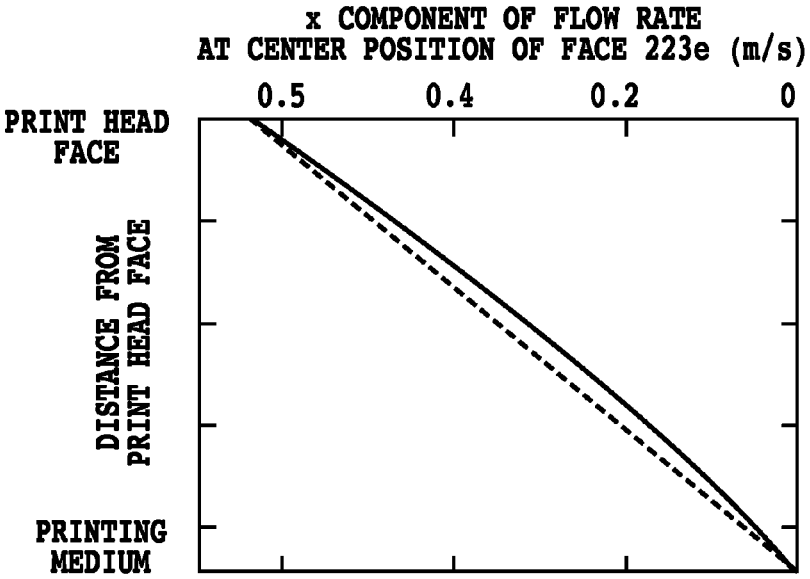
Figure 8F:
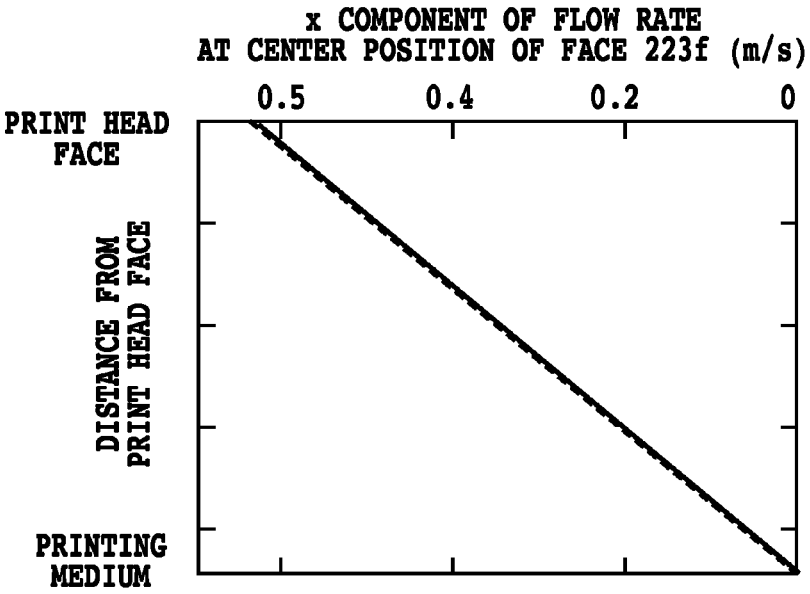

FIGS. 6A and 6B are diagrams for explaining the shape of a carriage and print heads on the side facing a printing medium in accordance with a second embodiment of an inkjet printing apparatus to which the present invention may be applied. In the present embodiment, print heads project toward a printing medium, and there is provided a variant-height surface 1*a* around the print heads whose height differs from the print head faces (223*a* to 223*f*). Additionally, this variant-height surface 1*a* is provided with an airflow control member 7*a* for maintaining the amount of influx air currents in the region between print heads and printing medium on the basis of ideas similar to the first embodiment. In so doing, the air pressure rises on either side of the first print head through the third print head, due to a mechanism similar to a configuration of the first embodiment as illustrated in FIGS. 4A and 4B (see FIG. 7 for an example). In so doing, air flowing in between carriage and printing medium at the front of the print heads in the carriage moving direction 6 reaches all the way to the third print head, while the escape of air in the sheet feed and discharge directions is suppressed. However, in order to prevent interference with a printing medium, a configuration is preferably such that the airflow control member 7*a* does not have a portion that projects toward a printing medium farther than the print head faces.

In the graphs in FIGS. 8A to 8F, solid lines illustrate exemplary height distributions for the x component of the flow rate in a fixed coordinate system at the center positions of the respective print head faces 223*a* to 223*f*. In FIGS. 8A to 8F, the vertical axis represents the distance from a print head face, and the horizontal axis represents the x component of the flow rate, with influx air currents increasing as a graph bulges to the right. Compared to the related art, by moving the position where influx air currents start to escape in the sheet feed and discharge directions to a position behind the third print head in the carriage moving direction 6, there is an advantage of increased influx air currents over the related art, even for the fourth print head and subsequent heads.

In this way, by increasing influx air currents at the ejection units of each print head compared to the related art, it becomes possible to effectively suppress rising air currents heading toward the print head faces (223*a* to 223*f*) which cause ink mist to adhere to the print head faces.

In FIGS. 6A and 6B herein, the individual print heads are surrounded by a member 229 co-planar with the print head faces 223*a* to 223*f* in order to reduce interference between print heads and printing medium. However, the individual print heads may also not be surrounded by a member co-planar with the print head faces 223*a* to 223*f*. In this case, the distance from the position where air is contracted to the ejection units of the print heads slightly decreases by an amount equivalent to the missing member 229 surrounding the print heads. This has an advantage of enabling ejection at positions where the decay of influx air currents is not as progressed.

In FIGS. 6A and 6B herein, the airflow control member 7*a* is taken to be linear or planar in shape, but it should be appreciated that the member may also have a curved shape.

Third Embodiment

Figure 9:
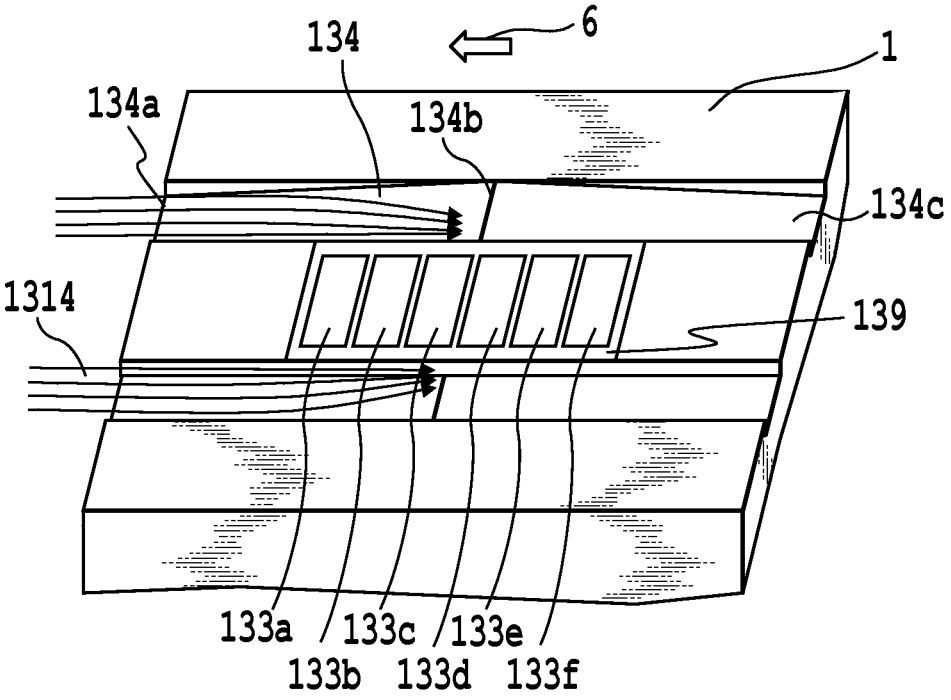
FIG. 9 is a diagram for explaining a configuration of a third embodiment of the present invention.

FIG. 9 schematically illustrates a carriage and print heads in accordance with a third embodiment of an inkjet apparatus to which the present invention may be applied, and also illustrates the state of air currents thereon.

A recess 134 is provided in the carriage 1 in parallel with the carriage moving direction 6 on either side of the print heads in the carriage moving direction 6. The recess 134 communicates with the space in the forward and rear moving directions of the carriage 1 via an aperture 134*a*.

Figure 10:
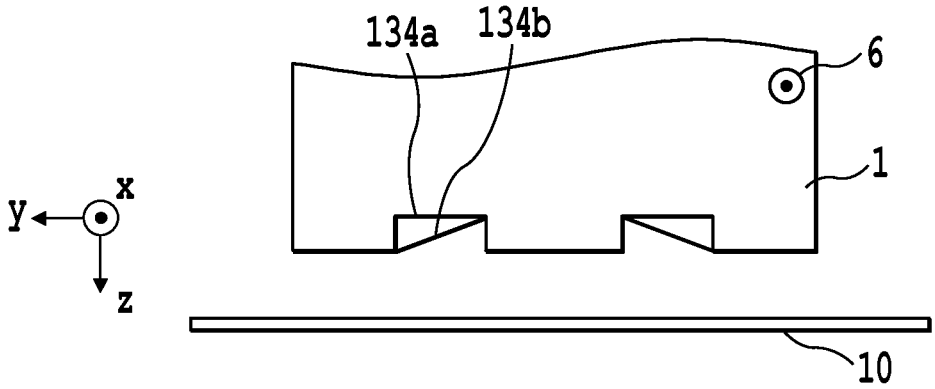
FIG. 10 illustrates the carriage in FIG. 9 as viewed from the front in the carriage moving direction.

Additionally, the bottom surface 134*c* of the recess slopes in both the x-axis direction and the y-axis direction, with its cross-sectional area becoming smaller toward the interior of the carriage 1 along the carriage moving direction 6. In so doing, the cross-sectional area in the direction orthogonal to the moving direction of the carriage 1 in the interior of the recess 134 is configured to have a small cross-section 134*b* that is smaller than the aperture 134*a*. Herein, in order to prevent interference with a printing medium, a configuration is preferably such that the height inside the recess at the small cross-section 134*b* is the same height as the print head faces, or farther away from a printing medium than the print head faces. FIG. 10 schematically illustrates the configuration of the present embodiment illustrated in FIG. 9 as viewed from the front in the carriage moving direction 6.

According to a configuration of the present embodiment, the air pressure rises on either side of the first print head through the third print head in the carriage moving direction 6, due to a mechanism similar to the first embodiment.

In the present embodiment, the slope provided in the bottom surface of the recess 134*c* may be additionally configured such that the center of gravity position of the small cross-section 134*b* is positioned farther inward in the ejection port array direction (i.e., toward the region where ejection ports are formed) than the center of gravity position of the aperture 134*a*. In so doing, air 1314 inside the recess develops an inclination facing inward in the ejection port array direction, and it becomes possible to suppress the tendency of influx air currents flowing in between print heads and printing medium to escape outward in the ejection port array direction.

As a result of the above, air flowing in between carriage and printing medium at the front of the print heads 3 in the carriage moving direction 6 reaches all the way to the third print head, while the escape of air in the sheet feed and discharge directions is suppressed.

Fourth Embodiment

Figure 11A:
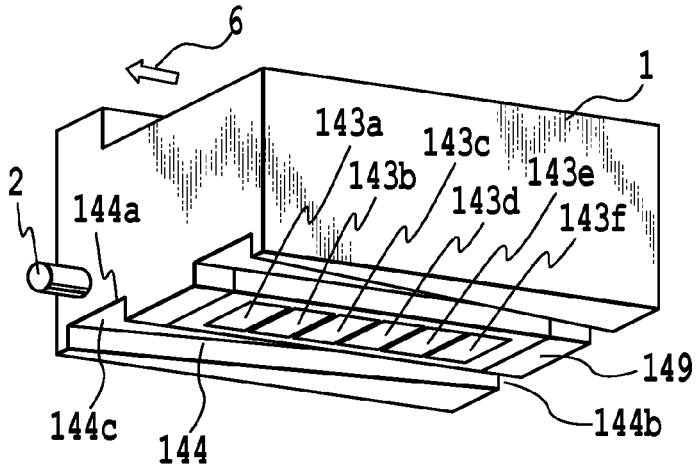
FIGS. 11A to 11C illustrate a configuration of a fourth embodiment of the present invention.
Figure 11B:
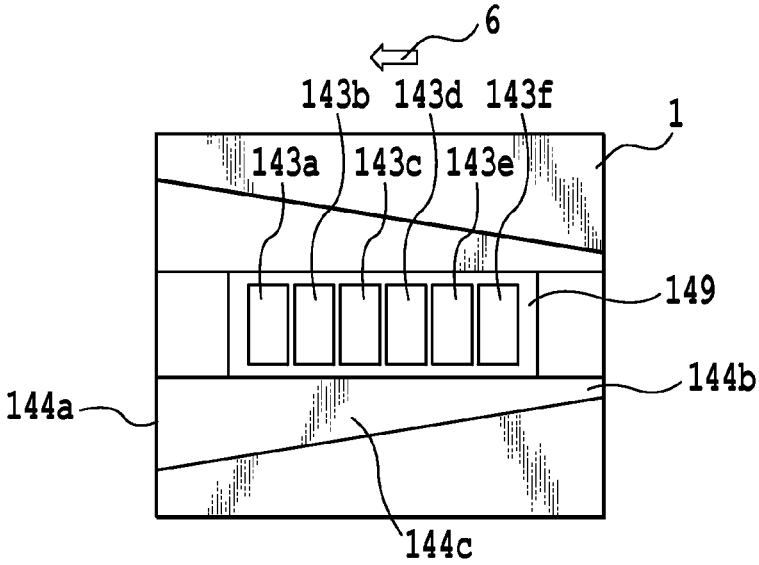
Figure 11C:
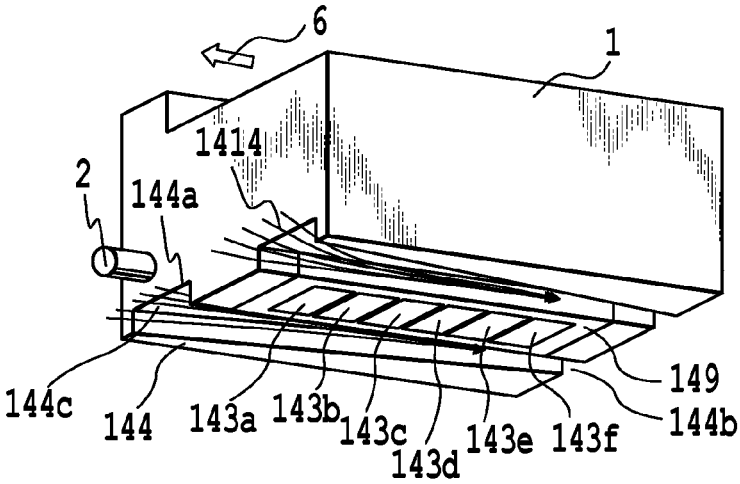

FIG. 11A is a perspective view of a carriage and print heads in accordance with a fourth embodiment of an inkjet printing apparatus to which the present invention may be applied. FIG. 11B illustrates the configuration in FIG. 11A as viewed from a printing medium. FIG. 11C is a diagram for explaining the state of air currents.

A recess 144 is provided in the carriage 1 in parallel with the carriage moving direction 6 on either side of the print heads in the carriage moving direction 6. The recess 144 communicates with the space in the forward and rear moving directions of the carriage 1 via an aperture 144*a*.

Additionally, the width of the recess 144 in the y-axis direction is wide at the forward edge position in the carriage moving direction 6, and narrows toward the rear edge position.

In so doing, the cross-sectional area in the direction orthogonal to the moving direction of the carriage 1 in the interior of the recess 144 is configured to have a small cross-section 144*b* that is smaller than the aperture 144*a*.

According to a configuration of the present embodiment, the air pressure rises on either side of the first print head through the sixth print head in the carriage moving direction 6, due to a mechanism similar to the first embodiment. That is, air flow passage becomes narrower toward the small cross-section 144*b* so that air 1414 flowing into the recess 144 via the aperture 144*a* is harder to flow through the recess than in the case without the slopes, thereby the air pressure rising in the region between the recess and a printing medium (see FIG. 11C). In so doing, the pressure rises on either side of the first print head through the sixth print head in the carriage moving direction 6.

Figure 12A:
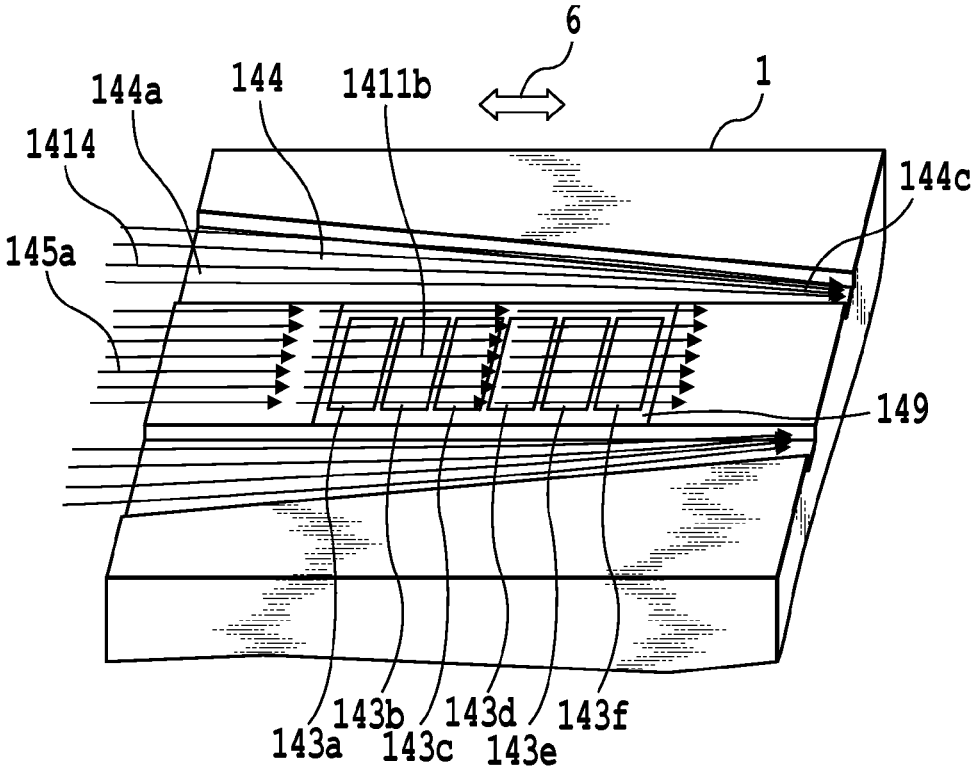
FIGS. 12A and 12B are diagrams for explaining functions and advantages of the configuration in FIGS. 11A to 11C.
Figure 12B:
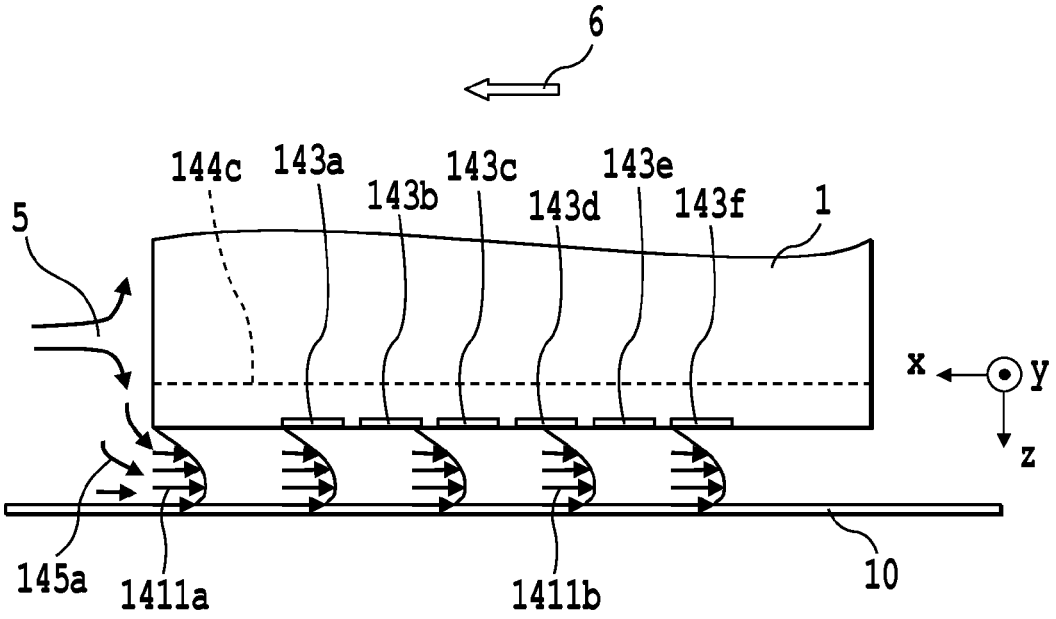

In so doing, as illustrated in FIG. 12A, air 145*a* flowing in between carriage and printing medium at the front of the print heads in the carriage moving direction 6 reaches all the way to the sixth print head, while the escape of air in the sheet feed and discharge directions is suppressed. In other words, the amount of influx air currents (1411*a* to 1411*b*) can be maintained all the way to the sixth print head (see FIG. 12B).

In the present embodiment, the change in the width of the recess 144 in the y-axis direction may also be configured such that the center of gravity position of the small cross-section 144*b* is positioned farther inward in the ejection port array direction than the center of gravity position of the aperture 144*a*. In so doing, air 1414 inside the recess develops an inclination facing inward in the ejection port array direction, and it becomes possible to suppress the tendency of influx air currents (1411*a* to 1411*b*) flowing in between print heads and printing medium to escape outward in the ejection port array direction.

As a result of the above, air 145*a* flowing in between carriage and printing medium at the front of the print heads in the carriage moving direction 6 reaches all the way to the sixth print head, while the escape of air in the sheet feed and discharge directions is suppressed.

In this way, by increasing influx air currents at the ejection units of each print head compared to the related art, it becomes possible to effectively suppress rising air currents heading toward the print head faces (143*a* to 143*f*) which cause ink mist to adhere to the print head faces.

Figure 13A:
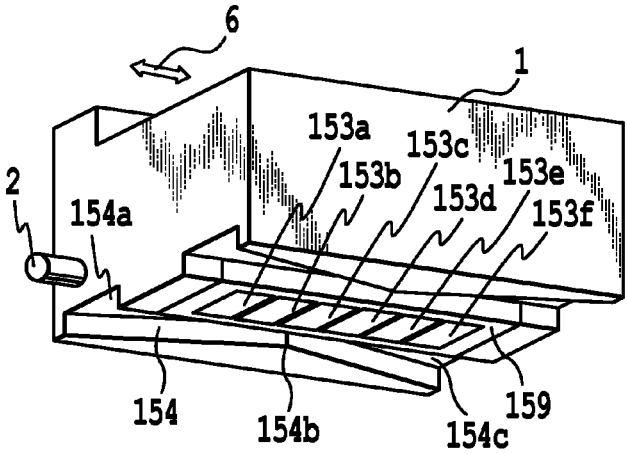
FIGS. 13A to 13C illustrate a modification of the fourth embodiment of the present invention.
Figure 13B:
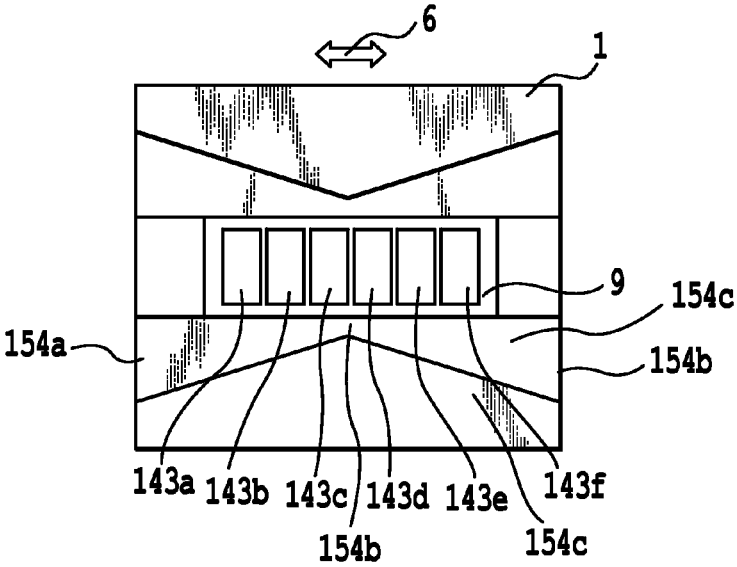

In addition, although the carriage 1 moves backwards and forwards in the main scan direction, in the case where an image is printed in both the forward direction and the backward direction, a configuration is preferably such that the shape inside the recess is symmetrical with respect to the carriage moving direction 6 as illustrated in FIGS. 13A and 13B. In the configuration in FIGS. 13A and 13B, the width of the recess 154 in the y-axis direction narrows toward the interior of the carriage 1 along the carriage moving direction 6. However, the small cross-section 154*b* is not required to be positioned at the center position of the carriage 1. For example, consider the case of an ejection port array that ejects ink of a color mounted onto just a single print head during both forward moving and backward moving, and furthermore wherein the ejection port array is positioned at the approximate center of the carriage. In this case, the small cross-section 154*b* may be positioned near the ejection port array.

Figure 13C:
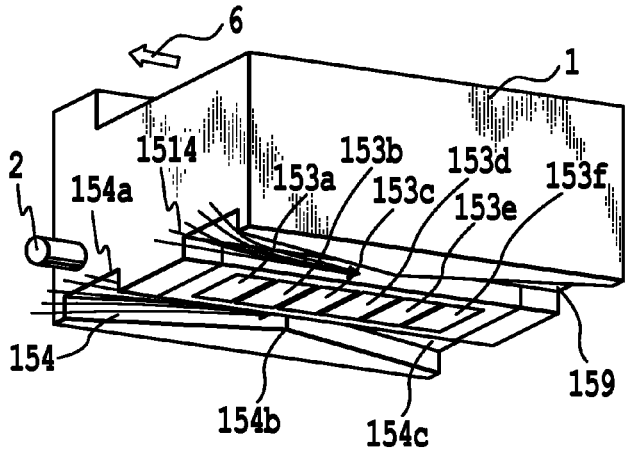
Figure 14A:
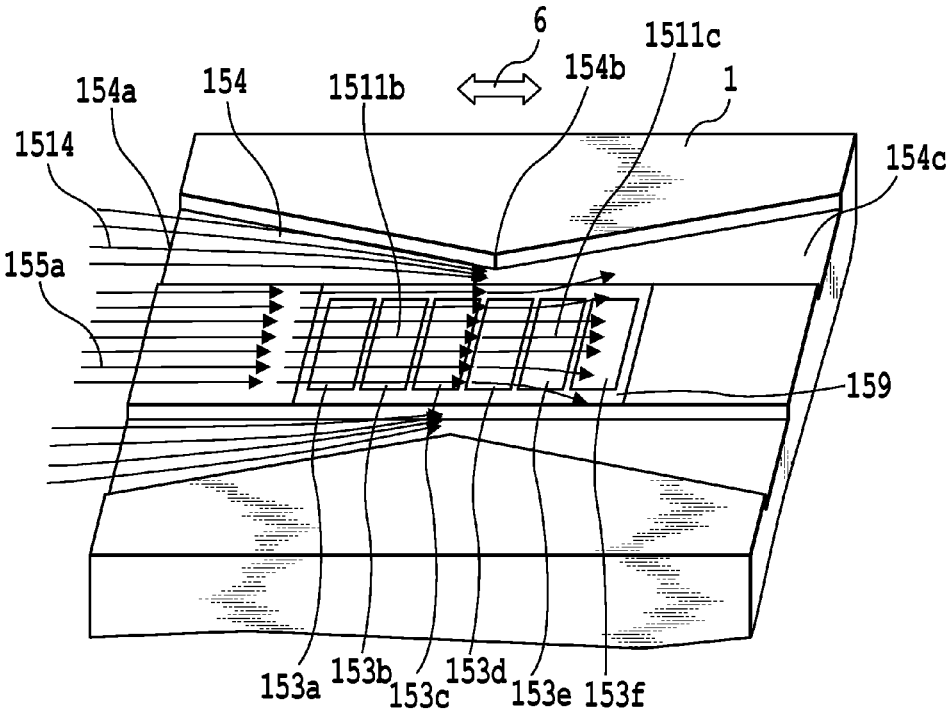
FIGS. 14A and 14B are diagrams for explaining functions and advantages of the configuration illustrated in FIGS. 13A to 13C.
Figure 14B:
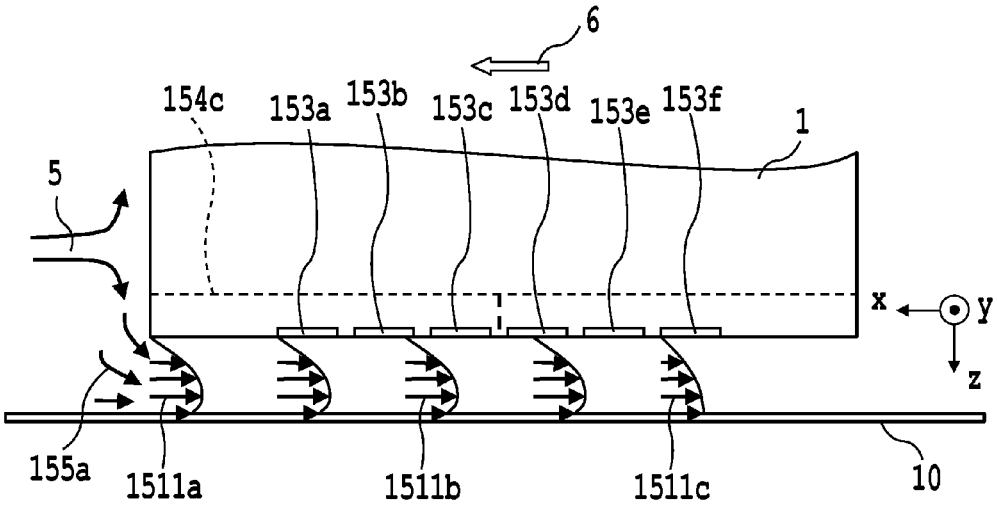

This configuration makes air flow passage narrower toward the small cross-section 154*b* so that air 1514 flowing into the recess 154 via the aperture 154*a* is harder to flow through the recess than in the case without the slopes, thereby the air pressure rising in the region between the recess and a printing medium (see FIG. 13C). In so doing, the air pressures rises on either side in the carriage moving direction 6 of the first print head through the third print head in FIG. 13A. Thus, as illustrated in FIGS. 14A and 14B, air 155*a* flowing in between carriage and printing medium at the front of the print heads in the carriage moving direction 6 reaches all the way to the third print head, while the escape of air in the sheet feed and discharge directions is suppressed. In other words, the amount of influx air currents can be maintained all the way to the third print head.

Since the above mechanism does not work on either side in the carriage moving direction 6 of the fourth print head through the sixth print head positioned behind the narrow position 154*b* of the recess 154 in the carriage moving direction 6, the phenomenon of influx air currents escaping in the sheet feed and discharge directions does occur (see FIG. 14A).

However, compared to the related art, by moving the position where influx air currents start to escape in the sheet feed and discharge directions to a position behind the third print head in the carriage moving direction 6, there is an advantage of increased influx air currents over the related art, even for the fourth print head and subsequent heads.

In this way, by increasing influx air currents at the ejection units of each print head compared to the related art, rising air currents heading toward the print head faces 153*a* to 153*f* which cause ink mist to adhere to the print head faces can be effectively suppressed.

In FIGS. 11A to 11C and FIGS. 13A to 13C herein, the inner walls of the recess are taken to be planar in shape, but it should be appreciated that the inner walls may also have a curved shape.

Hereinafter, embodiments will be given for the case of printing an image during both forward moving and backward moving of the carriage 1, but in the case of printing an image only during moving in one direction, the configuration should be modified similar to the relationship between FIGS. 1A and 1B versus FIGS. 4A and 4B, or the relationship between FIGS. 11A to 11C versus FIGS. 13A to 13C.

Fifth Embodiment

Figure 15A:
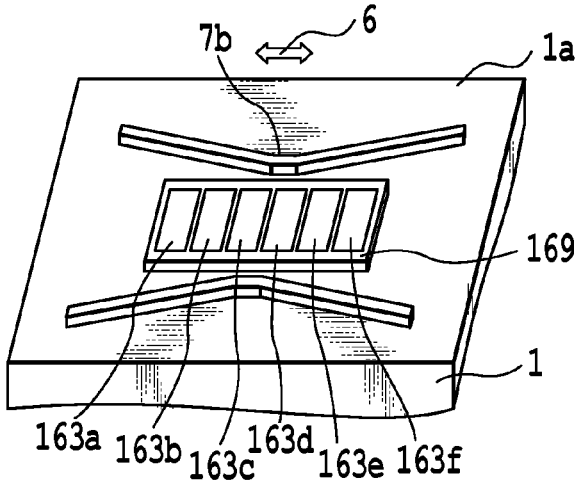
FIGS. 15A to 15C are diagrams for explaining a configuration of a fifth embodiment of the present invention.

FIGS. 15A and 158 are perspective views illustrating the shape of a carriage and print heads on the side facing a printing medium in accordance with a fifth embodiment of an inkjet printing apparatus to which the present invention may be applied. FIG. 15C illustrates the configuration illustrated in FIGS. 15A and 15B as viewed from a printing medium.

In the present embodiment, print heads project toward a printing medium, and there is provided a variant-height surface 1*a* around the print heads 3 whose height differs from the print head faces 163*a* to 163*f*. Additionally, this variant-height surface 1*a* is provided with an airflow control member 7*b* for maintaining the amount of influx air currents in the region between print heads and printing medium on the basis of ideas similar to the fourth embodiment.

Figure 16:
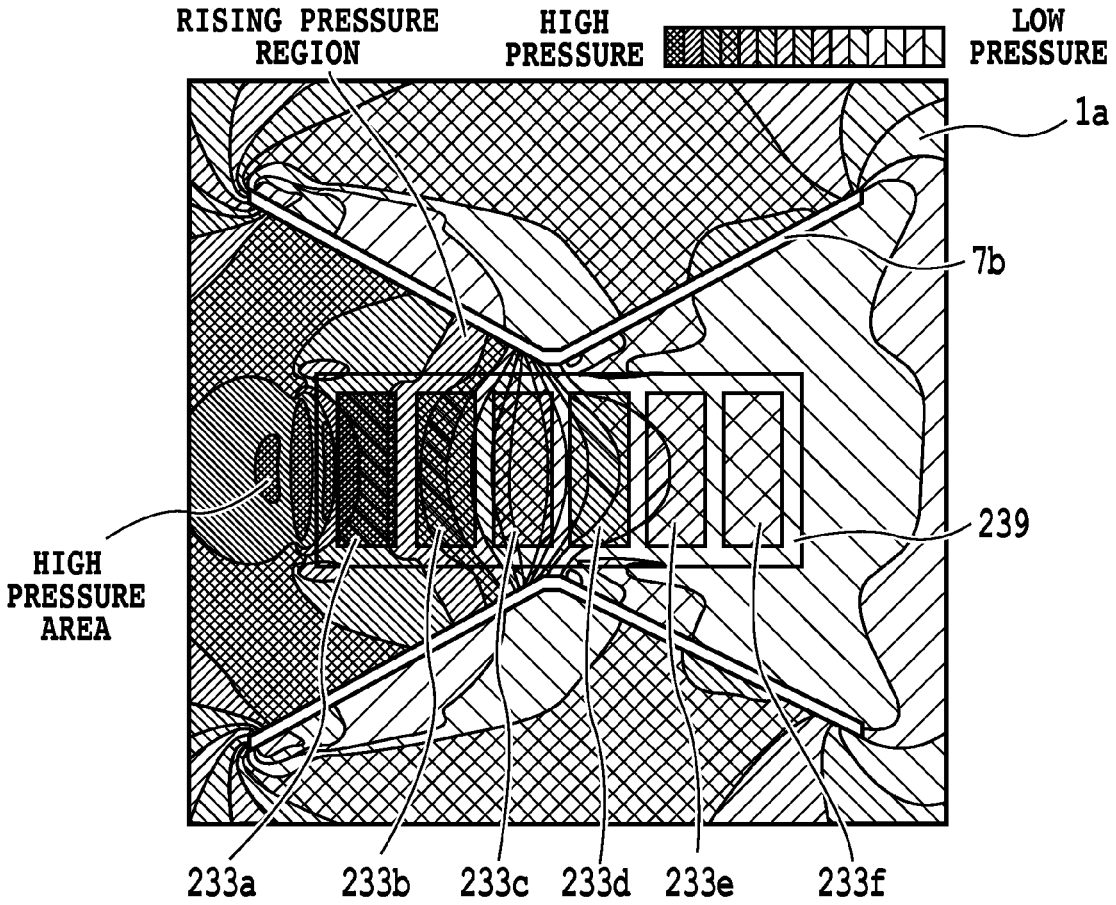
FIG. 16 illustrates an exemplary wall surface pressure distribution near the first through sixth print heads in the configuration of the fifth embodiment illustrated in FIGS. 15A to 15C.
Figure 17A:
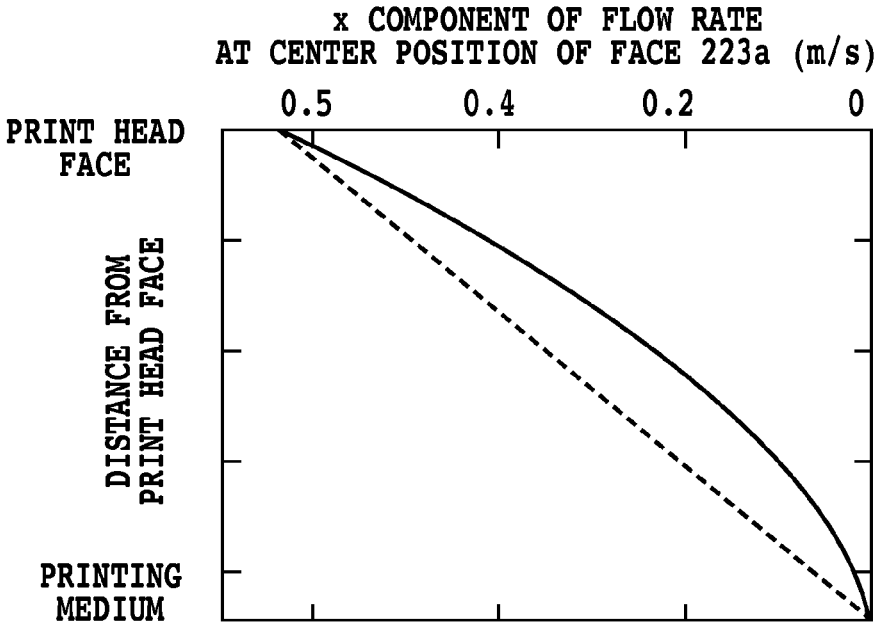
FIGS. 17A to 17F illustrate exemplary height distributions for the x component of the flow rate in a fixed coordinate system at the center positions of the respective faces of the first through sixth print heads in the configuration illustrated in FIGS. 15A to 15C.
Figure 17B:
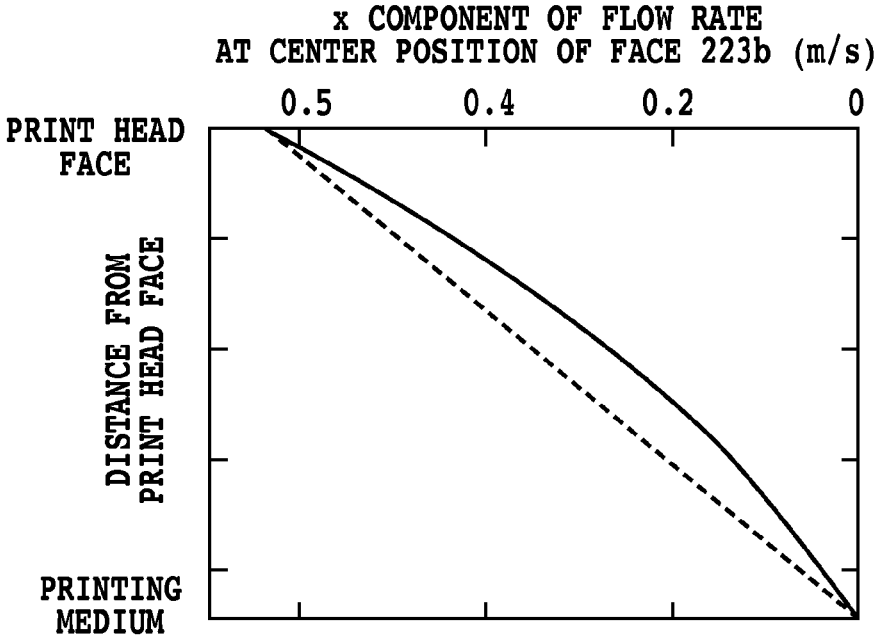
Figure 17C:
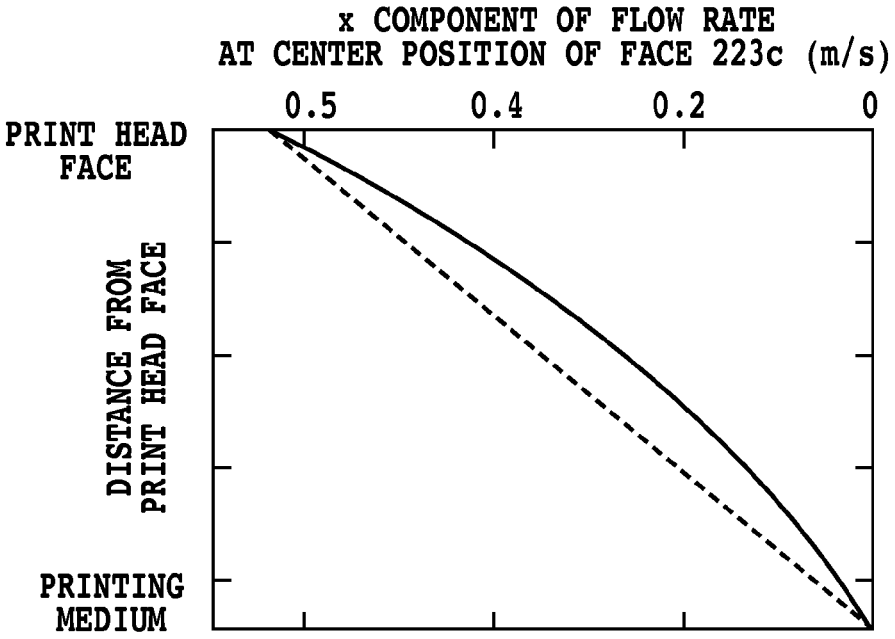
Figure 17D:
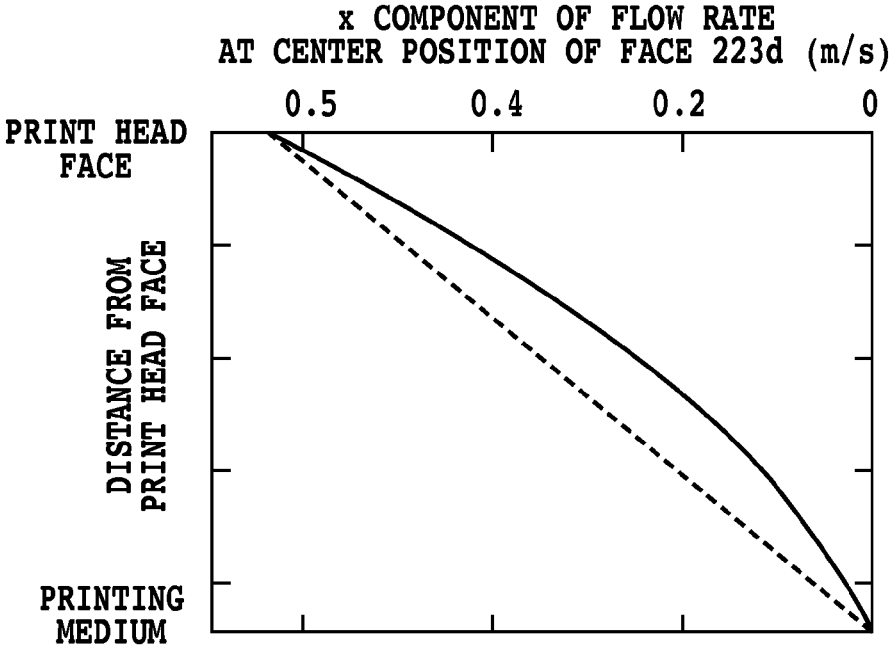
Figure 17E:
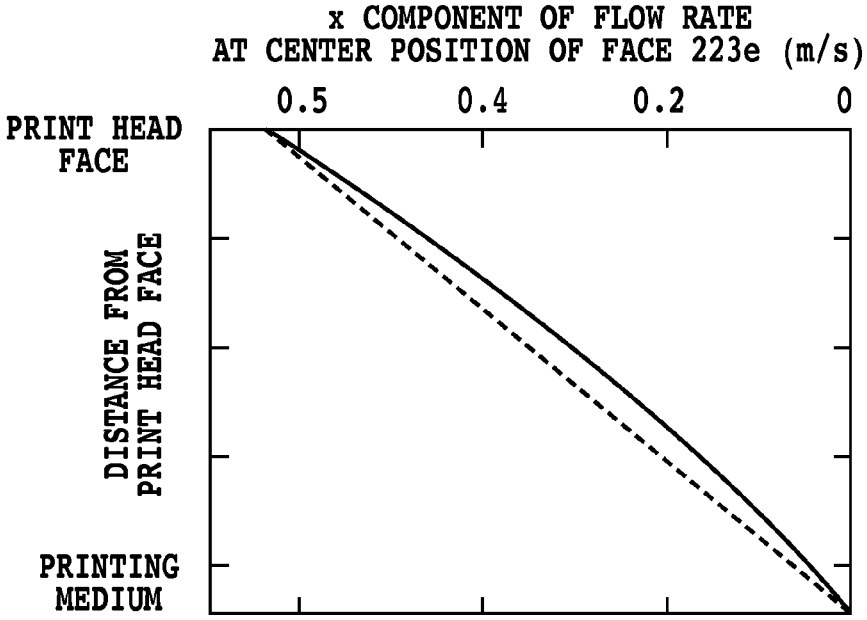
Figure 17F:
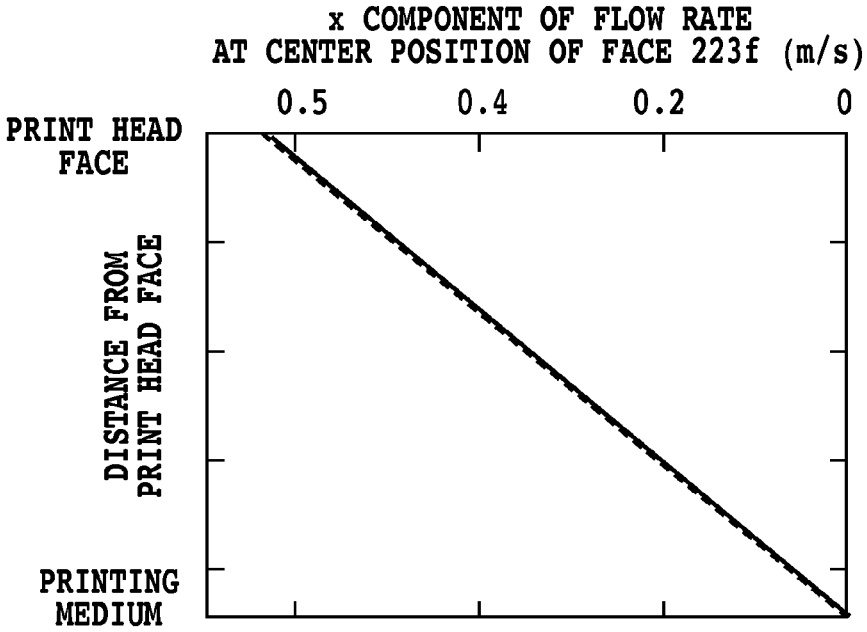

In so doing, the air pressure rises on either side of the first print head through the third print head, due to a mechanism similar to a configuration of the fourth embodiment as illustrated in FIGS. 13A to 13C and FIGS. 14A to 14C (see FIG. 16 for an example). In so doing, air flowing in between carriage and printing medium at the front of the print heads in the carriage moving direction 6 reaches all the way to the third print head, while the escape of air in the sheet feed and discharge directions is suppressed. However, in order to prevent interference with a printing medium, a configuration is preferably such that the airflow control member 7*b* does not have a portion that projects toward a printing medium farther than the print head faces.

In the graphs in FIGS. 17A to 17F, solid lines illustrate exemplary height distributions for the x component of the flow rate in a fixed coordinate system at the center positions of the respective print head faces 233*a* to 233*f*. In FIGS. 17A to 17F, the vertical axis represents the distance from a print head face, and the horizontal axis represents the x component of the flow rate, with influx air currents increasing as a graph bulges to the right. Compared to the related art, by moving the position where influx air currents start to escape in the sheet feed and discharge directions to a position behind the third print head in the carriage moving direction 6, there is an advantage of increased influx air currents over the related art, even for the fourth print head and subsequent heads.

In this way, by increasing influx air currents at the ejection units of each print head compared to the related art, it becomes possible to effectively suppress rising air currents heading toward the print head faces 163*a* to 163*f* which cause ink mist to adhere to the print head faces.

Figure 15B:
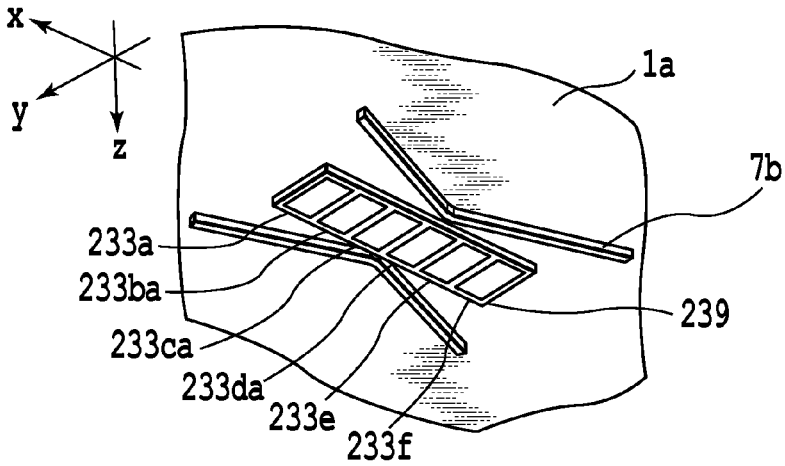
Figure 15C:
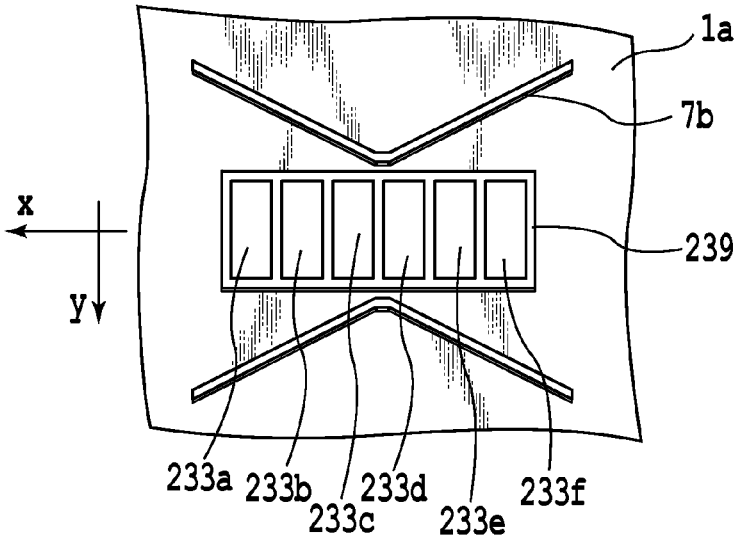
Figure 18:
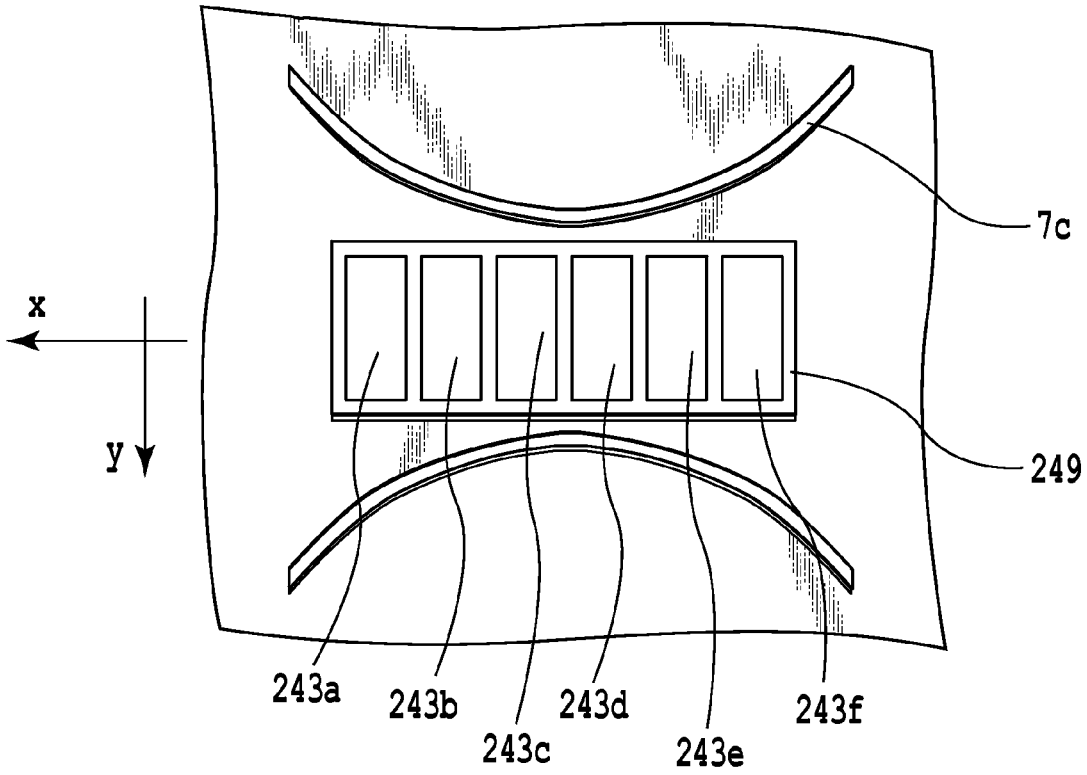
FIG. 18 is a diagram for explaining a modification of the fifth embodiment of the present invention.
Figure 19:
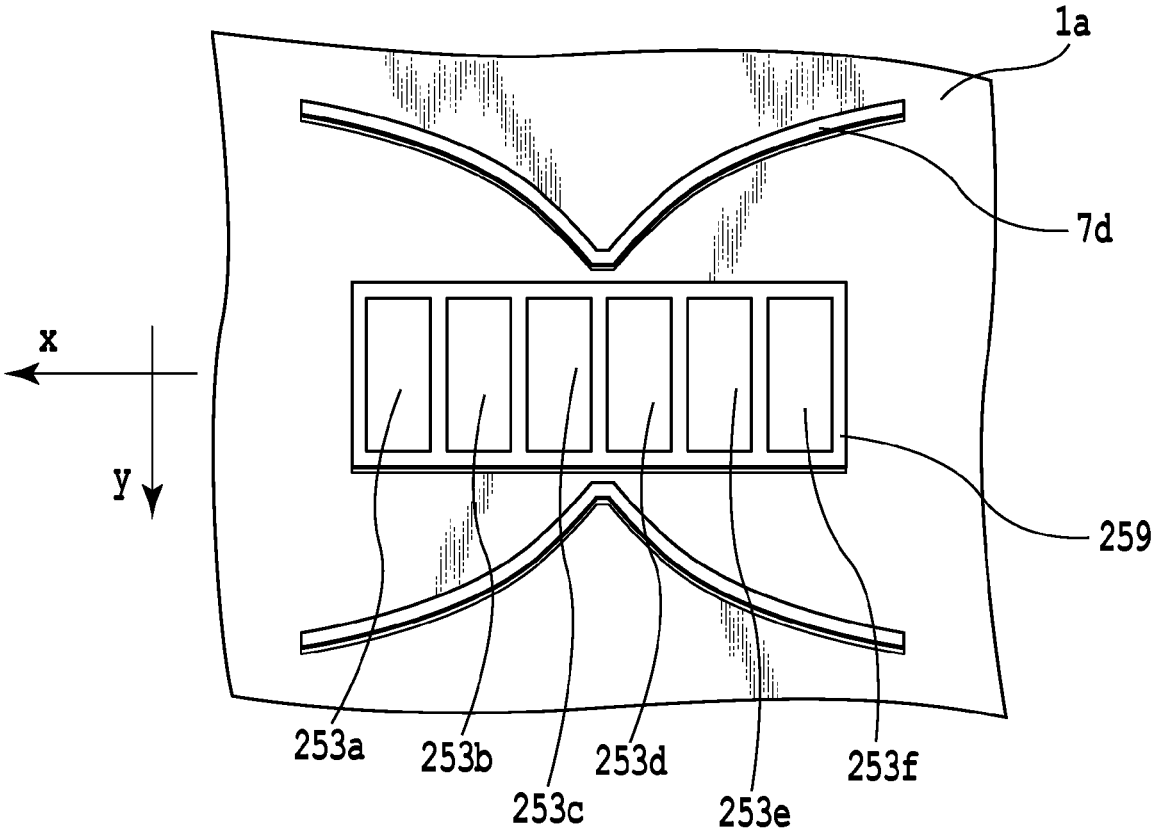
FIG. 19 is a diagram for explaining another modification of the fifth embodiment of the present invention.

In FIGS. 15A to 15C herein, the airflow control member 7*b* is taken to be linear or planar in shape, but it should be appreciated that the member may also have a curved shape as in FIGS. 18 and 19.

Furthermore, in FIGS. 15A to 15C, the individual print heads are surrounded by a member 169 co-planar with the print head faces 163*a* to 163*f* in order to reduce interference between print heads and printing medium. However, the individual print heads may also not be surrounded by a member co-planar with the print head faces. In this case, the distance from the position where air is contracted to the ejection units of the print heads slightly decreases by an amount equivalent to the missing member 169 surrounding the print heads. This has an advantage of enabling ejection at positions where the decay of influx air currents is not as progressed.

Sixth Embodiment

Figure 20A:
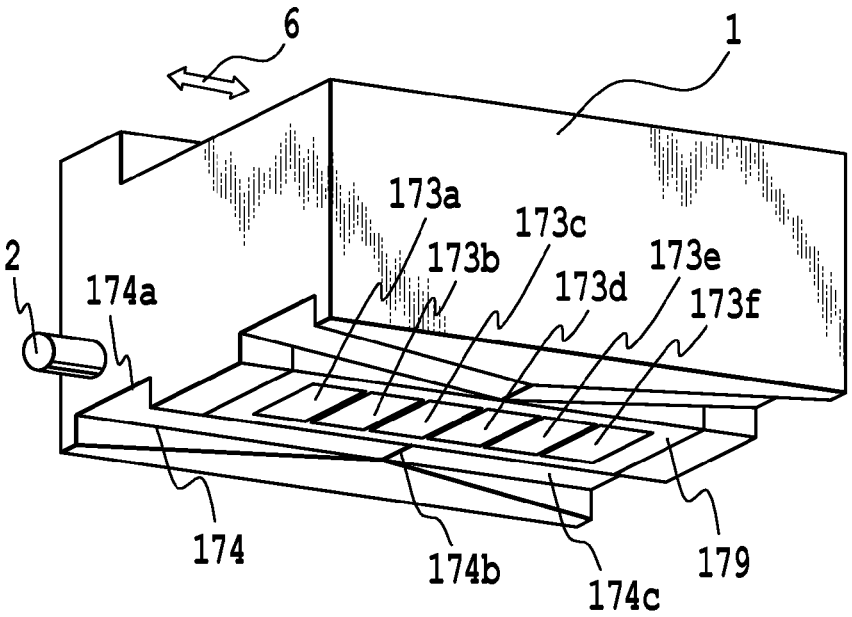
FIGS. 20A and 20B are diagrams for explaining a configuration of a sixth embodiment of the present invention.
Figure 20B:
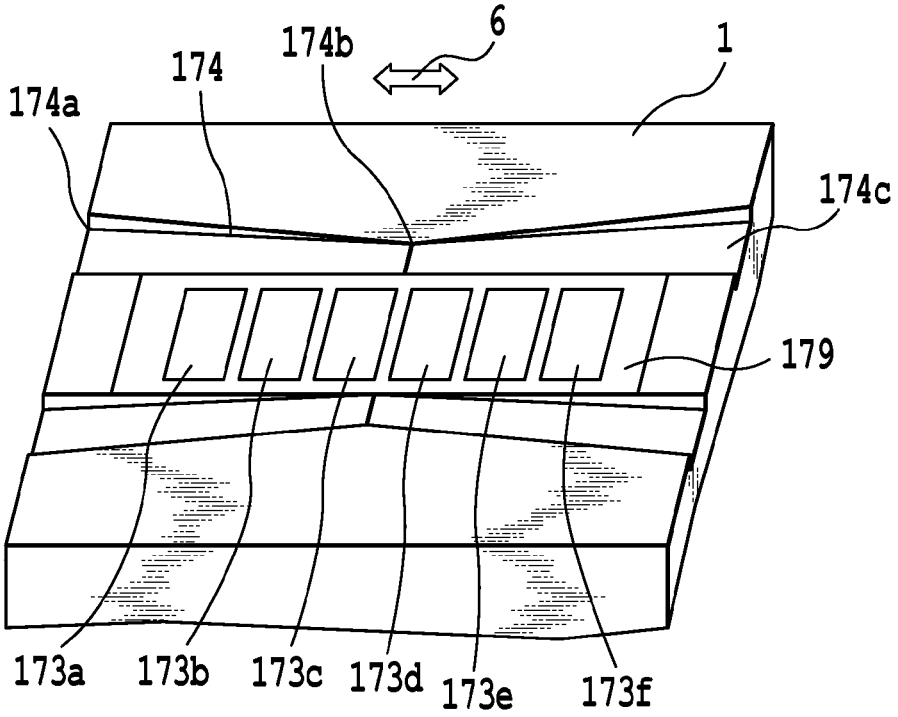

FIG. 20A illustrates a perspective view of a carriage and print heads in accordance with a sixth embodiment of an inkjet printing apparatus to which the present invention may be applied. FIG. 20B illustrates the shape of a carriage and print heads on the side facing a printing medium in accordance with the present embodiment. A recess 174 is formed on the carriage 1 in parallel with the carriage moving direction 6 on either side of the print heads in the carriage moving direction 6. The recess 174 communicates with the space in the forward and rear moving directions of the carriage 1 via an aperture 174*a*.

Additionally, on the basis of ideas similar to a configuration of the first embodiment in FIGS. 4A to 4C, the bottom surface 174*c* of the recess slopes along the carriage moving direction 6, with the depth of the recess 174 becoming shallower toward the interior of the carriage 1 in the carriage moving direction 6.

Furthermore, on the basis of ideas similar to a configuration of the fourth embodiment in FIGS. 13A to 13C, the width of the recess 174 in the y-axis direction narrows toward the interior of the carriage 1 along the carriage moving direction 6.

In so doing, the cross-sectional area in the direction orthogonal to the moving direction of the carriage 1 in the interior of the recess 174 is configured to have a small cross-section 174*b* that is smaller than the aperture 174*a*.

Herein, the height inside the recess at the small cross-section 174*b* may be the same height as the print head faces or a different height. However, in order to prevent interference with a printing medium, a configuration is preferably such that the height inside the recess at the small cross-section 174*b* is the same height as the print head faces, or farther away from a printing medium than the print head faces.

According to a configuration of the present embodiment, the air pressure rises on either side of the first print head through the third print head in the carriage moving direction 6, due to a mechanism similar to the first embodiment and the fourth embodiment.

Figure 21A:
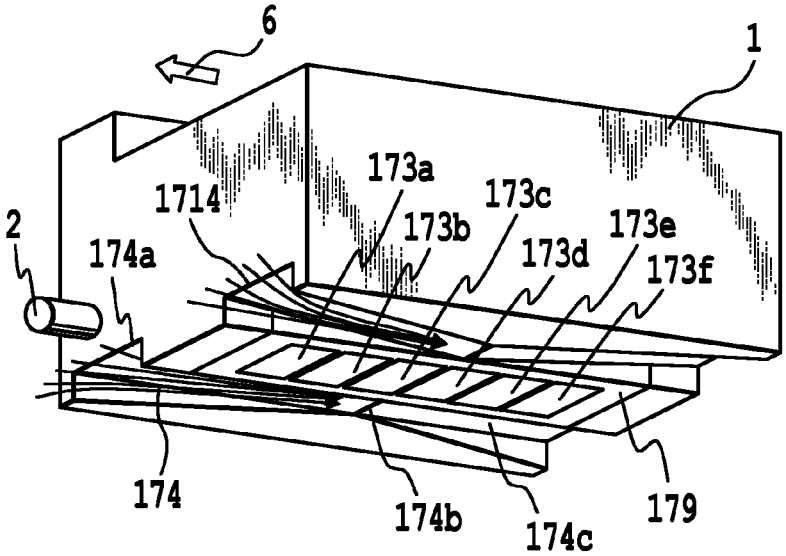
FIGS. 21A and 21B are diagrams for explaining the state of air currents inside a recess in a configuration of the sixth embodiment of the present invention.
Figure 21B:
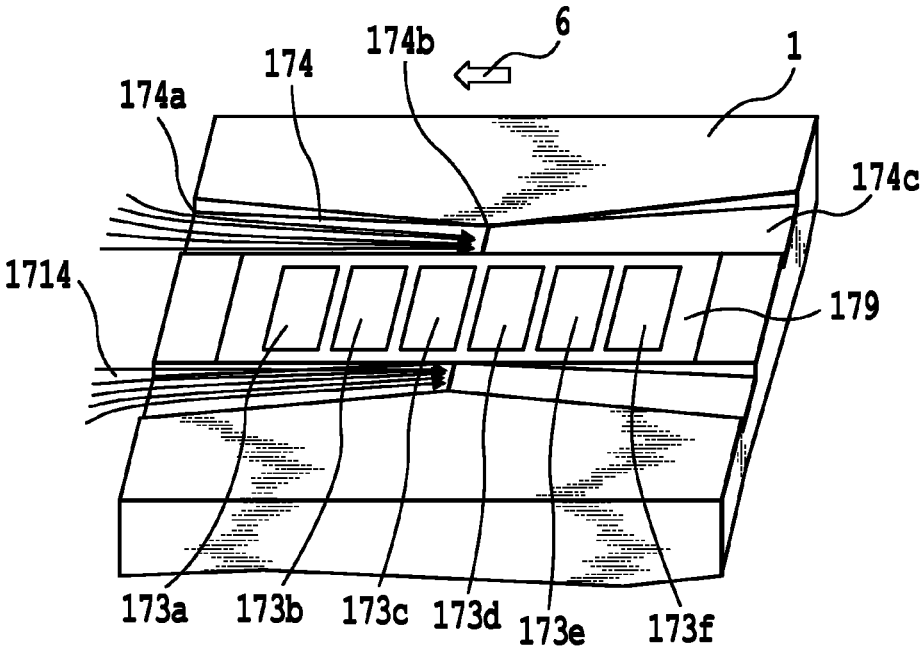

In the present embodiment, the width of the recess 174 in the y-axis direction may also be configured such that the center of gravity position of the small cross-section 174*b* is positioned farther inward in the ejection port array direction than the center of gravity position of the aperture 174*a*. In so doing, air 1714 inside the recess develops an inclination facing inward in the ejection port array direction, and it becomes possible to suppress the tendency of influx air currents flowing in between print heads and printing medium to escape outward in the ejection port array direction (FIGS. 21A and 21B).

By moving the position where influx air currents start to escape in the sheet feed and discharge directions to a position behind the third print head in the carriage moving direction 6, there is an advantage of increased influx air currents over the related art, even for the fourth print head and subsequent heads.

By increasing influx air currents at the ejection units of each print head in this way, it becomes possible to effectively suppress rising air currents heading toward the print head faces 173*a* to 173*f* which cause ink mist to adhere to the print head faces. In FIGS. 20A and 20B herein, the inner walls of the recess are taken to be planar in shape, but it should be appreciated that the inner walls may also have a curved shape.

Seventh Embodiment

Figure 22A:
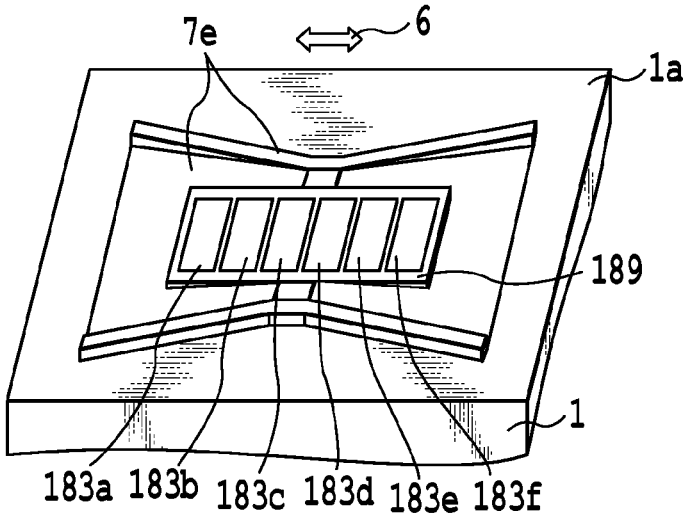
FIGS. 22A to 22C are diagrams for explaining a configuration of a seventh embodiment of the present invention.
Figure 22B:
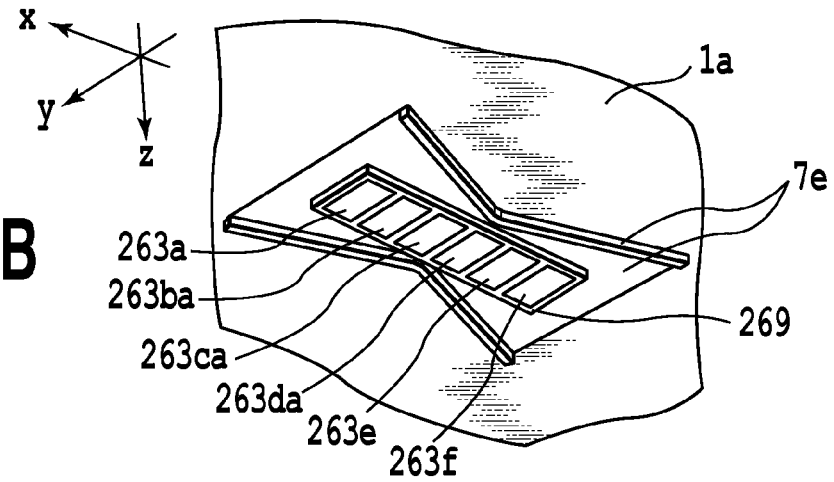
Figure 22C:
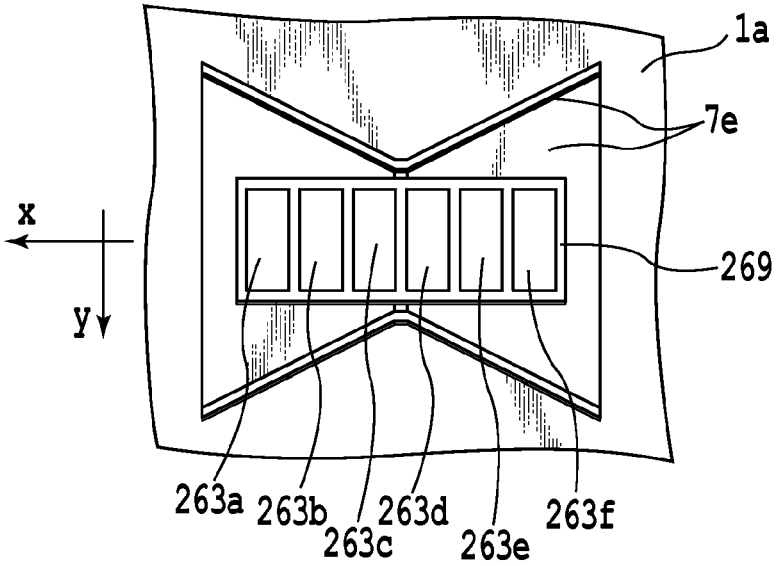
Figure 23A:
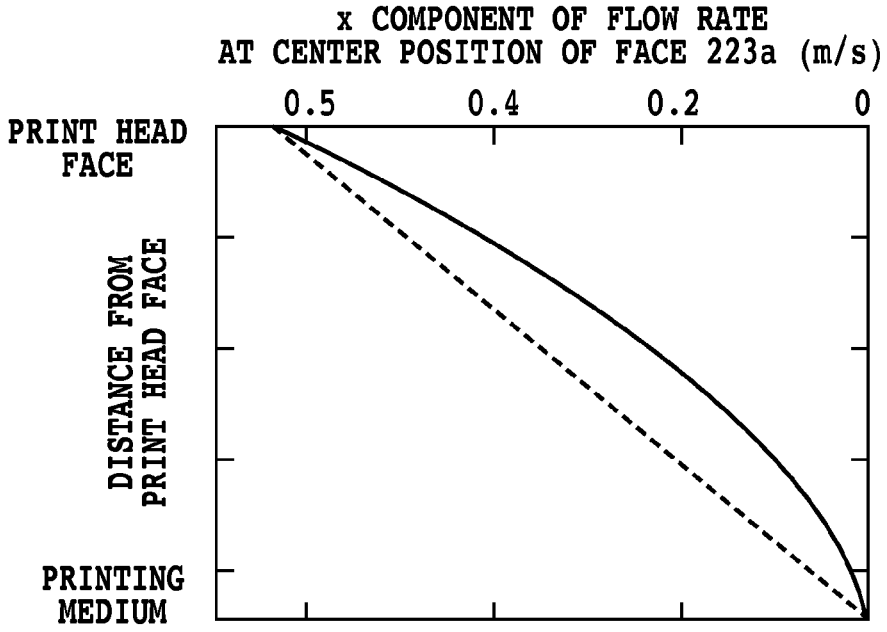
FIGS. 23A to 23F illustrate exemplary height distributions for the x component of the flow rate in a fixed coordinate system at the center positions of the respective faces of the first through sixth print heads in the seventh embodiment.
Figure 23B:
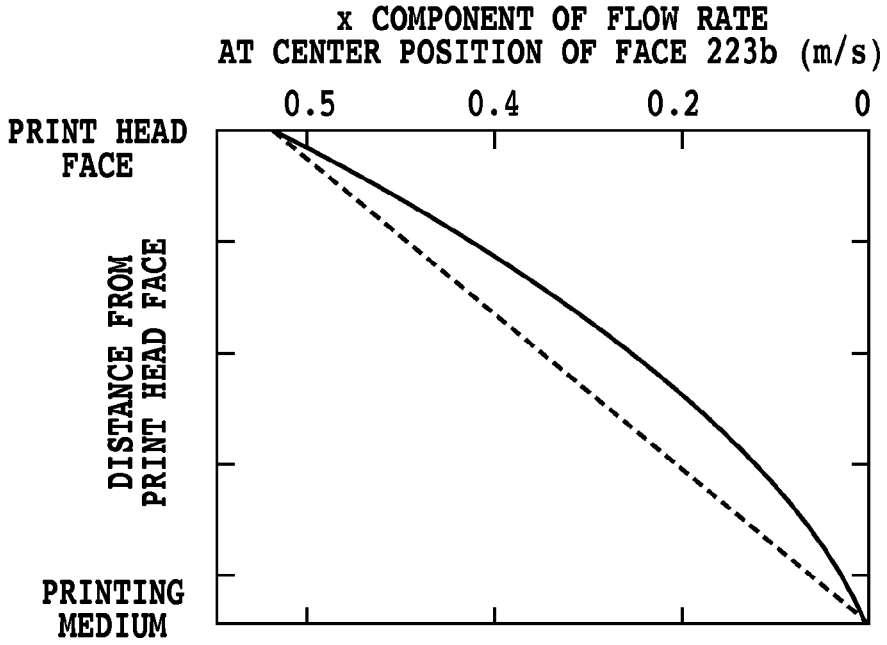
Figure 23C:
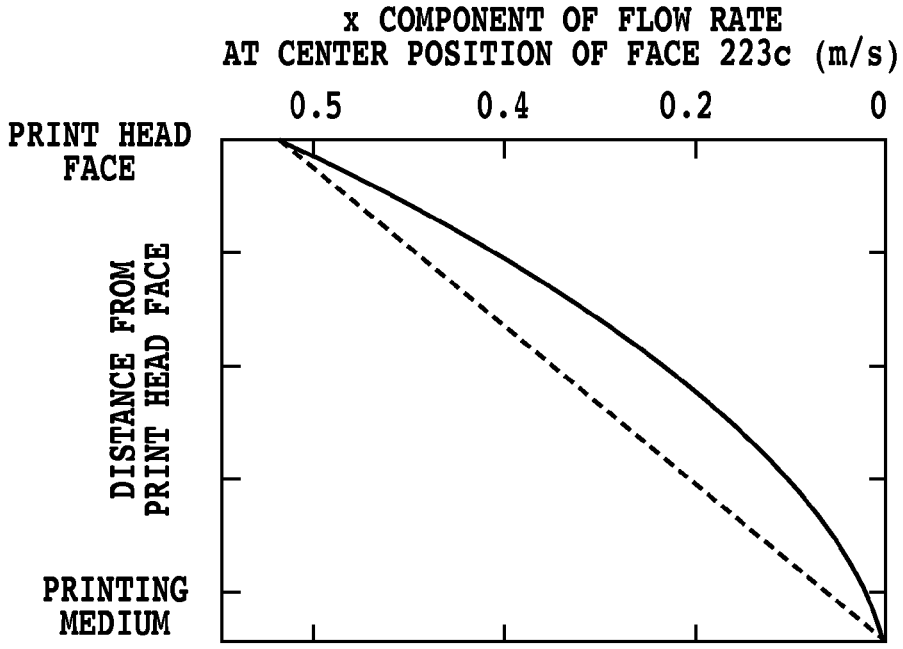
Figure 23D:
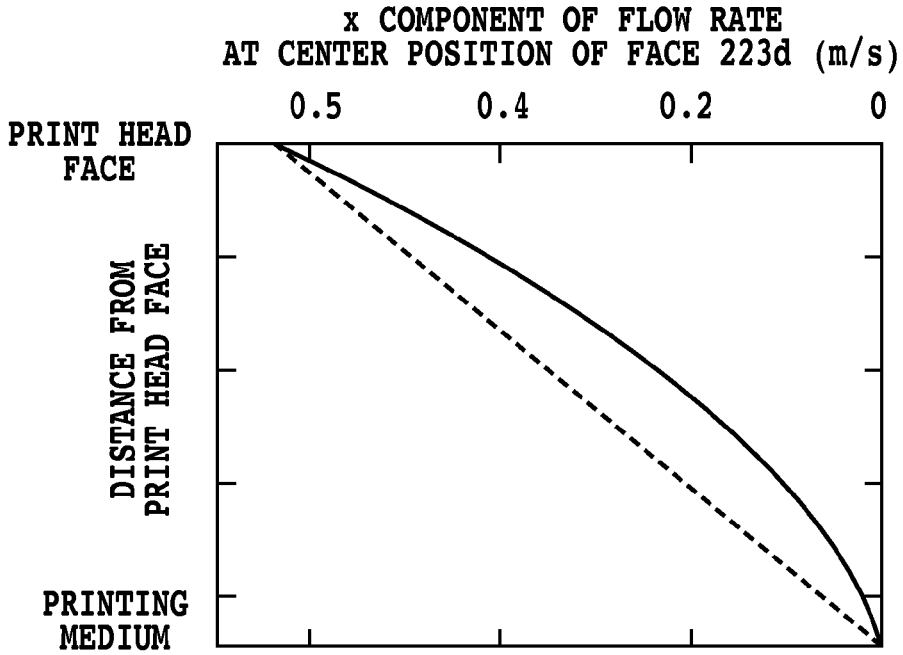
Figure 23E:
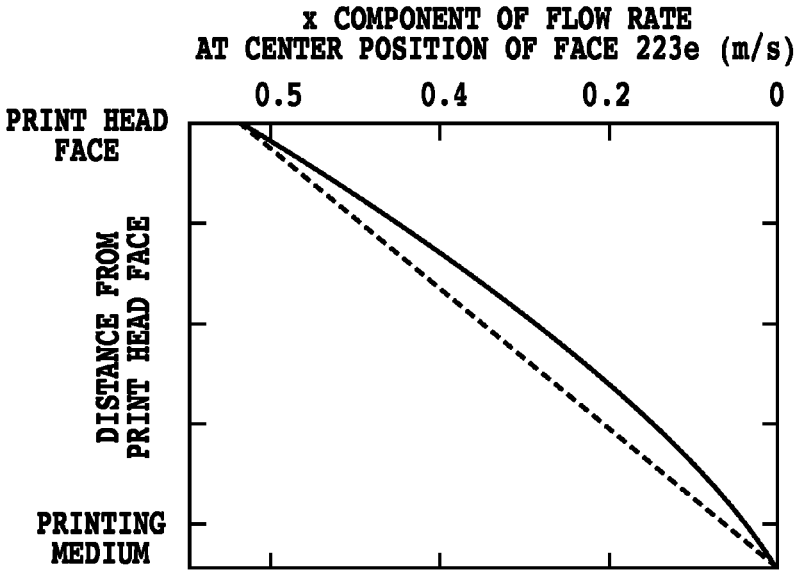
Figure 23F:
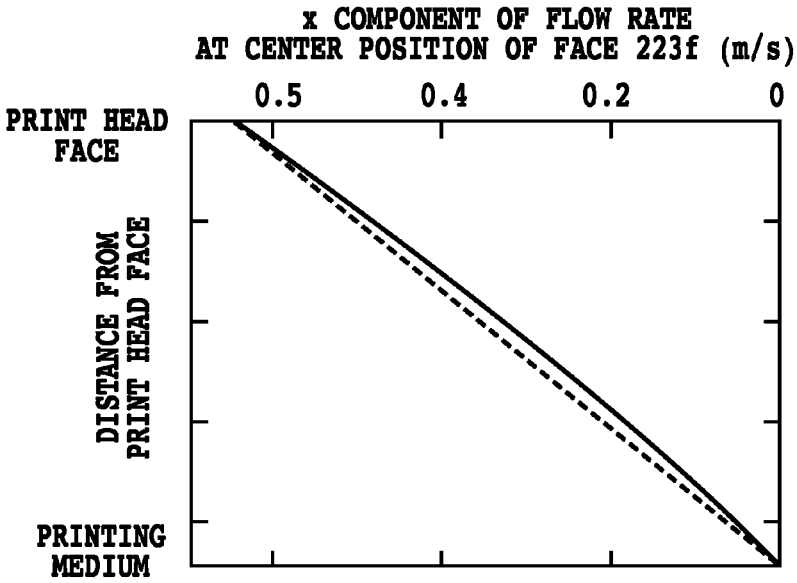

FIGS. 22A and 22B are perspective views illustrating the shape of a carriage and print heads on the side facing a printing medium in accordance with a seventh embodiment of an inkjet printing apparatus to which the present invention may be applied. FIG. 22C illustrates the configuration illustrated in FIGS. 22A and 22B as viewed from a printing medium.

In the present embodiment, print heads 3 project toward a printing medium, and there is provided a variant-height surface 1*a* around the print heads 3 whose height differs from the print head faces 183*a* to 183*f*. Additionally, this variant-height surface 1*a* is provided with an airflow control member 7*e* for maintaining the amount of influx air currents in the region between print heads and printing medium on the basis of ideas similar to the sixth embodiment.

In so doing, the air pressure rises on either side of the first print head through the third print head, due to a mechanism similar to a configuration of the sixth embodiment as illustrated in FIGS. 20A and 20B. In so doing, air flowing in between carriage and printing medium at the front of the print heads 3 in the carriage moving direction 6 reaches all the way to the third print head, while the escape of air in the sheet feed and discharge directions is suppressed. However, in order to prevent interference with a printing medium, a configuration is preferably such that the airflow control member 7*e* does not project toward a printing medium farther than the print head faces.

In the graphs in FIGS. 23A to 23F, solid lines illustrate exemplary height distributions for the x component of the flow rate in a fixed coordinate system at the center positions of the respective print head faces 263*a* to 263*f*. In FIGS. 23A to 23F, the vertical axis represents the distance from a print head face, and the horizontal axis represents the x component of the flow rate, with influx air currents increasing as a graph bulges to the right. Compared to the related art, by moving the position where influx air currents start to escape in the sheet feed and discharge directions to a position behind the third print head in the carriage moving direction 6, there is an advantage of increased influx air currents over the related art, even for the fourth print head and subsequent heads.

By increasing influx air currents at the ejection units of each print head in this way, it becomes possible to effectively suppress rising air currents heading toward the print head faces 183*a* to 183*f* which cause ink mist to adhere to the print head faces. In FIGS. 22A to 22C herein, the airflow control member 7*e* is taken to be linear or planar in shape, but it should be appreciated that the member may also have a curved shape. Furthermore, in FIGS. 22A to 22C, the individual print heads are surrounded by a member 189 co-planar with the print head faces 183*a* to 183*f* in order to reduce interference between print heads 3 and printing medium. However, the individual print heads may also not be surrounded by a member co-planar with the print head faces. In this case, the distance from the position where air is contracted to the ejection units of the print heads slightly decreases by an amount equivalent to the missing member 189 surrounding the print heads. This has an advantage of enabling ejection at positions where the decay of influx air currents is not as progressed.

Eighth Embodiment

Figure 24A:
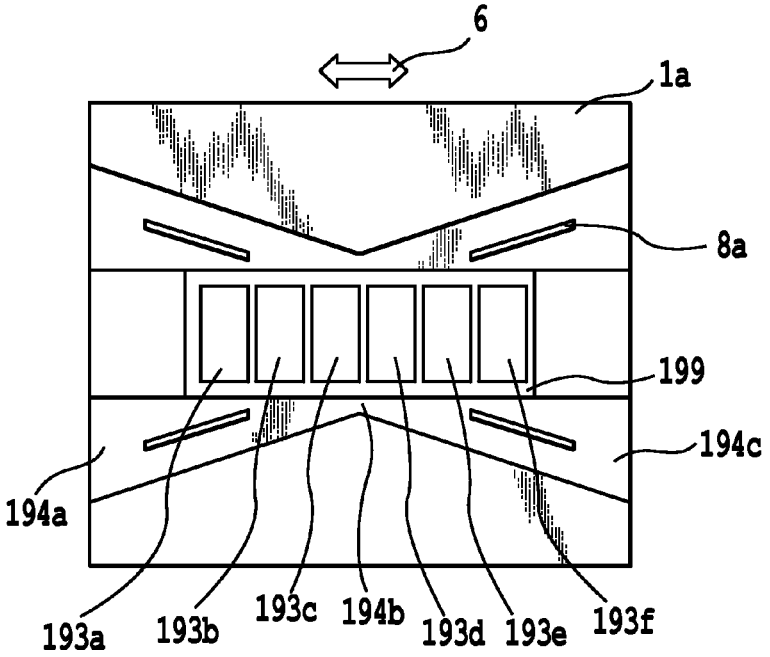
FIGS. 24A and 24B are diagrams for explaining a modification of a configuration of an eighth embodiment of the present invention.
Figure 24B:
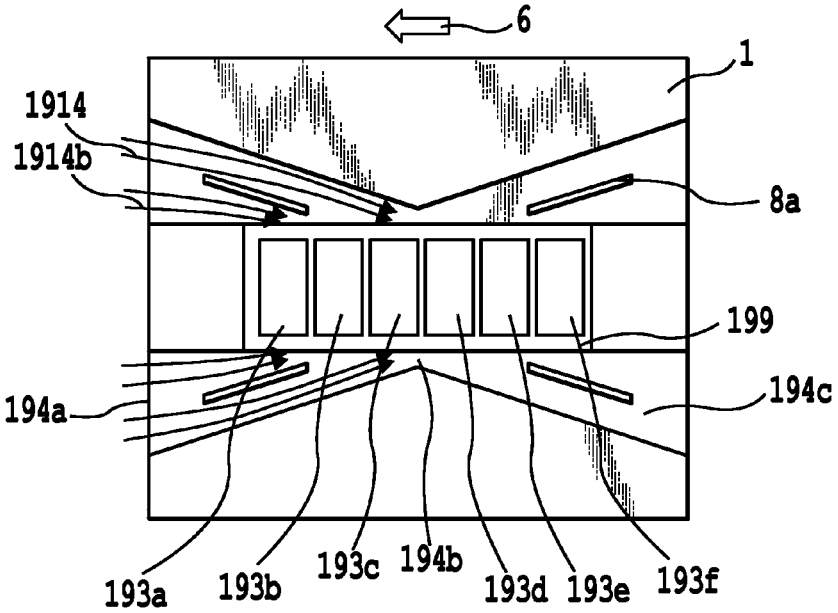

FIG. 24A illustrates a carriage and print heads as viewed from a printing medium in accordance with an eighth embodiment of an inkjet printing apparatus to which the present invention may be applied. FIG. 24B is a diagram for explaining the state of airflow.

The present embodiment is provided with a configuration of the fourth embodiment as illustrated in FIGS. 13A to 13C, and in addition, an airflow control support member 8*a* is provided in recesses 194*b* and 194*c*. By means of the airflow control support member 8*a*, air 1914 that has flowed into the recesses 194*b* and 194*c* via an aperture 194*a* is selectively guided inward in the ejection port array direction.

In so doing, it becomes possible for facing pairs of air currents 1914*b* tending to escape in the sheet feed and discharge directions to be produced at a specific place inside the recess by air flowing in between carriage and printing medium at the front of the print heads in the carriage moving direction 6 (see FIG. 24B). As a result, it becomes possible to adjust the magnitude of influx air currents between each print head and printing medium. For example, by providing an airflow control support member 8*a* near the first print head, it becomes possible to effectively suppress the escape of air in the sheet feed and discharge directions near the first print head by air flowing in between carriage and printing medium at the front of the print heads in the carriage moving direction 6. However, in order to prevent interference with a printing medium, a configuration is preferably such that the airflow control support member 8*a* does not project toward a printing medium farther than the print head faces.

In the present embodiment, air flowing in between carriage and printing medium at the front of the print heads in the carriage moving direction 6 reaches all the way to the third print head while the escape of air in the sheet feed and discharge directions is suppressed, due to a mechanism similar to the fourth embodiment. In other words, the amount of influx air currents can be maintained all the way to the third print head.

Compared to the related art, by moving the position where influx air currents start to escape in the sheet feed and discharge directions to a position behind the third print head in the carriage moving direction 6, there is an advantage of increased influx air currents over the related art, even for the fourth print head and subsequent heads.

In this way, by increasing influx air currents at the ejection units of each print head compared to the related art, it becomes possible to effectively suppress rising air currents heading toward the print head faces 193*a* to 193*f* which cause ink mist to adhere to the print head faces. In FIGS. 24A and 24B herein, the inner walls of the recess and the airflow control support member 8*a* are taken to be planar or linear in shape, but it should be appreciated that a curved shape is also possible. Furthermore, in FIGS. 24A and 24B, there are a total of four airflow control support members 8*a* for guiding air currents flowing into the recess 194 via the aperture 194*a* inward in the ejection port array direction, but it should be appreciated that the number of airflow control support members 8*a* may be an arbitrary number.

Ninth Embodiment

Figure 25A:
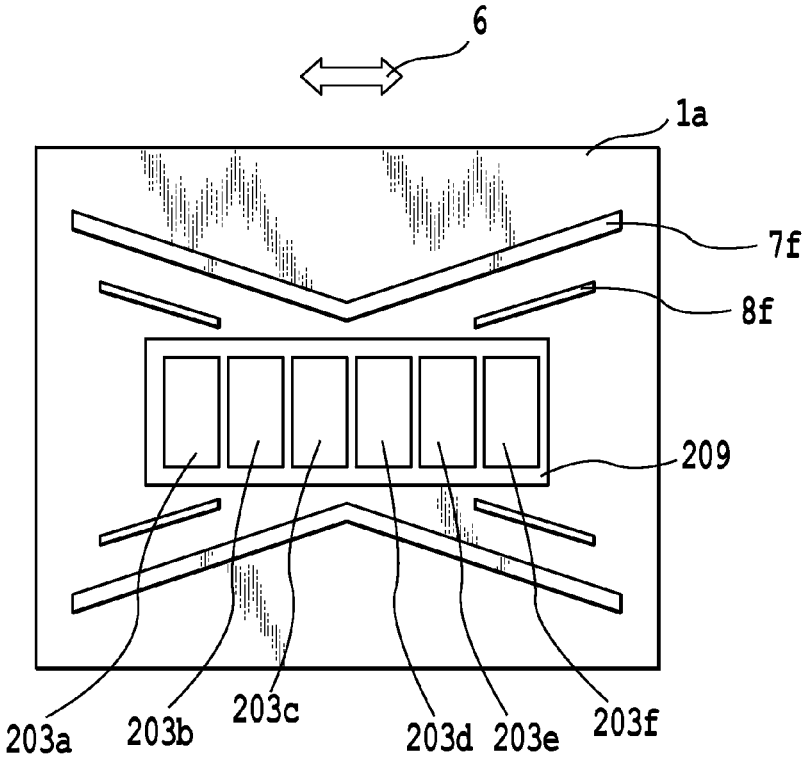
FIGS. 25A and 25B illustrate a configuration of a ninth embodiment of the present invention.
Figure 25B:
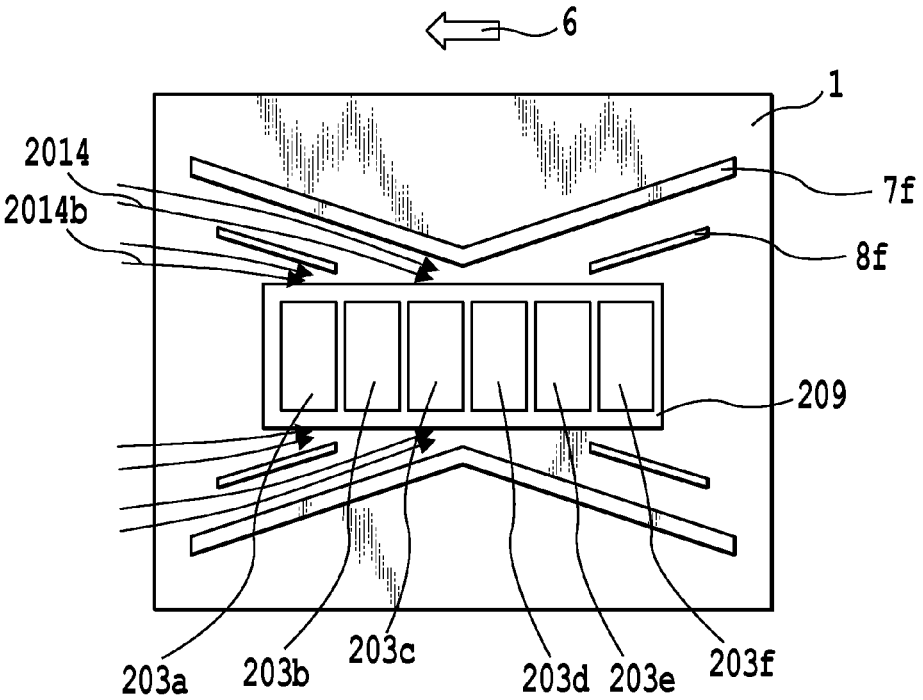

FIG. 25A illustrates a carriage and print heads as viewed from a printing medium in accordance with a ninth embodiment of an inkjet printing apparatus to which the present invention may be applied. FIG. 25B is a diagram for explaining the state of airflow.

In the present embodiment, print heads project toward a printing medium, and a variant-height surface 1*a* around the print heads whose height differs from the print head faces (203*a* to 203*f*).

Additionally, this variant-height surface 1*a* is provided with an airflow control support member 8*f* based on ideas similar to the eighth embodiment. The airflow control support member 8*f* selectively guides air 2014 flowing along an airflow control member 7*f* inward in the ejection port array direction.

In so doing, it becomes possible to adjust the amount of influx air currents in the region between each print head and printing medium, due to a mechanism similar to the eighth embodiment.

In the present embodiment, the air pressure rises on either side of the first print head through the third print head, similarly to the eighth embodiment. In so doing, air flowing in between carriage and printing medium at the front of the print heads 3 in the carriage moving direction 6 reaches all the way to the third print head, while the escape of air in the sheet feed and discharge directions is suppressed. However, in order to prevent interference with a printing medium, a configuration is preferably such that the airflow control member 7*f* and the airflow control support member 8*f* do not project toward a printing medium farther than the print head faces.

Compared to the related art, by moving the position where influx air currents start to escape in the sheet feed and discharge directions to a position behind the third print head in the carriage moving direction 6, there is an advantage of increased influx air currents over the related art, even for the fourth print head and subsequent heads.

In this way, by increasing influx air currents at the ejection units of each print head compared to the related art, it becomes possible to effectively suppress rising air currents heading toward the print head faces (203*a* to 203*f*) which cause ink mist to adhere to the print head faces.

Figure 26A:
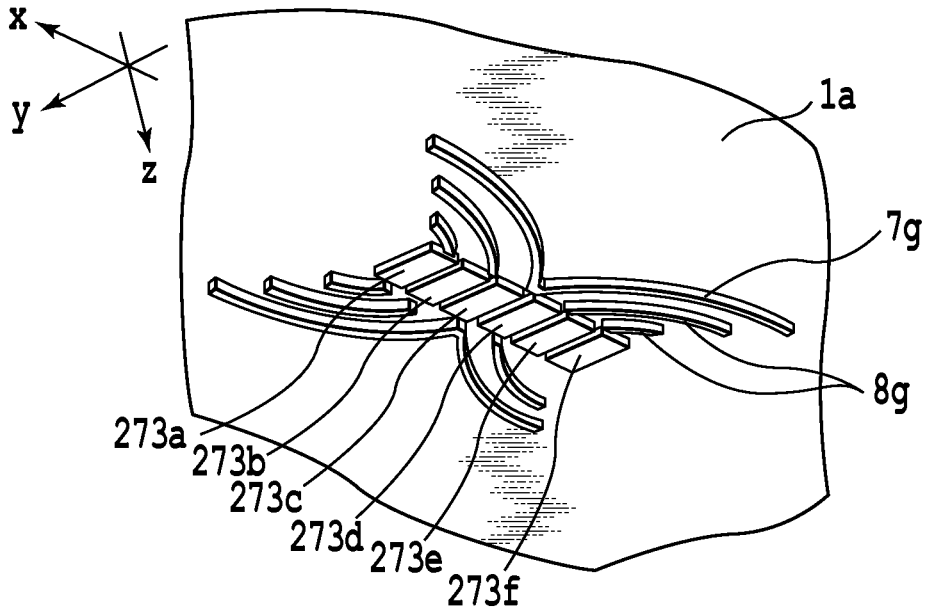
FIGS. 26A and 26B are diagrams for explaining a modification of the ninth embodiment of the present invention.
Figure 26B:
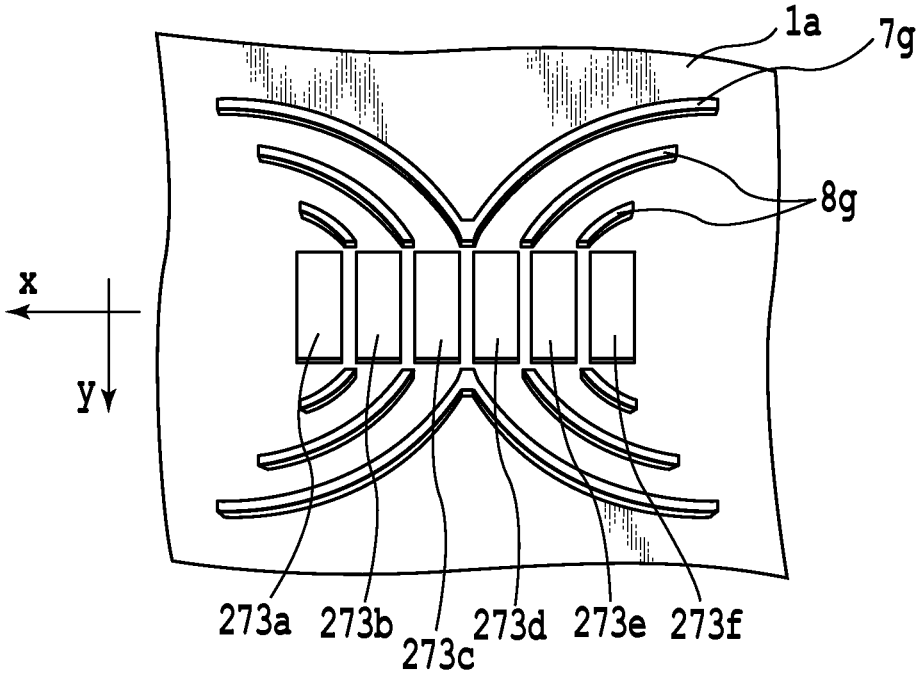

In FIGS. 25A and 25B herein, the airflow control member 7*f* and the airflow control support member 8*f* are taken to be planar or linear in shape, but it should be appreciated that a curved shape is also possible. Furthermore, in FIGS. 25A and 25B, the individual print heads are surrounded by a member 209 co-planar with the print head faces (203*a* to 203*f*) in order to reduce interference between print heads and printing medium. However, the individual print heads may also not be surrounded by a member co-planar with the print head faces. Furthermore, in FIGS. 25A and 25B, there are a total of four airflow control support members 8*f* for guiding air 2014 flowing along the airflow control member inward in the ejection port array direction, but it should be appreciated that there may also be an arbitrary number of airflow control support members 8*f* as illustrated in FIGS. 26A and 26B.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-114458, filed May 18, 2010, which is hereby incorporated by reference herein in its entirety.

What is claimed is:

1. An inkjet printing apparatus comprising:

a carriage upon which is mounted one or more print heads with ink ejection ports formed thereon;

a printing unit that prints an image onto a printing medium by causing ink droplets to be ejected toward the printing medium from the ink ejection ports while relative movement between the carriage and the printing medium is performed; and a recess portion formed outside of an area where the ejection ports are formed, in a conveyance direction in which the relative movement is performed, and recessed from a surface where the ejection ports are formed, wherein a cross-sectional area of the recess portion in a direction orthogonal to the conveyance direction at a center portion of the recess portion relative to the conveyance direction is less than a cross-sectional area of the recess portion in the direction orthogonal to the conveyance direction at an edge portion of the recess portion, and wherein the cross-sectional area of the recess portion in the direction orthogonal to the conveyance direction changes along the conveyance direction.

2. The inkjet printing apparatus according to claim 1, wherein no part of the recess portion projects toward the printing medium farther than faces of the print head where the ink ejection ports are formed.

3. The inkjet printing apparatus according to claim 1, wherein the edge portion of the recess portion has an open aperture in the conveyance direction.

4. The inkjet printing apparatus according to claim 1, wherein a center of gravity position of the cross-section at the central portion of the recess portion is positioned further toward the area where the ink ejection ports are formed as compared to a center of gravity position of the cross-section at the edge portion of the recess portion.

5. The inkjet printing apparatus according to claim 1, further comprising:

a support member provided in the recess portion for guiding air currents passing through the recess toward the area where the ink ejection ports are formed.

6. The inkjet printing apparatus according to claim 5, wherein no part of the support member projects toward the printing medium farther than faces of the print head where the ink ejection ports are formed.

7. The inkjet printing apparatus according to claim 1, wherein a depth of the center portion of the recess portion is shallower than a depth of the edge portion of the recess portion.

8. The inkjet printing apparatus according to claim 1, wherein a width of the recess portion in a second direction orthogonal to the conveyance direction at the center portion of the recess portion is less than a width of the recess portion in the second direction orthogonal to the conveyance direction at the edge portion of the recess portion.

* * * * *